US009211719B2

(12) United States Patent
Hayashi et al.

(10) Patent No.: US 9,211,719 B2
(45) Date of Patent: Dec. 15, 2015

(54) INK TANK

(71) Applicant: CANON KABUSHIKI KAISHA, Tokyo (JP)

(72) Inventors: Hiroki Hayashi, Kawasaki (JP); Tetsuya Ohashi, Matsudo (JP); Ryoji Inoue, Kawasaki (JP); Hironori Murakami, Tokyo (JP); Takashi Fukushima, Yokohama (JP); Norihiro Ikebe, Kawasaki (JP); Yasuo Kotaki, Yokohama (JP); Koki Yaegashi, Yonezawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/023,082

(22) Filed: Sep. 10, 2013

(65) Prior Publication Data

US 2014/0184708 A1 Jul. 3, 2014

(30) Foreign Application Priority Data

Dec. 28, 2012 (JP) ..... 2012-287248

(51) Int. Cl.
*B41J 2/175* (2006.01)

(52) U.S. Cl.
CPC ..... *B41J 2/17513* (2013.01)

(58) Field of Classification Search
CPC .... B41J 2/145; B41J 2/17503; B41J 2/17513; B41J 2/17553
USPC ..... 347/85, 86, 87
See application file for complete search history.

(56) References Cited

U.S. PATENT DOCUMENTS

| | | | | |
|---|---|---|---|---|
| 6,168,266 | B1 * | 1/2001 | Ishinaga et al. | 347/86 |
| 6,179,415 | B1 * | 1/2001 | Okazaki et al. | 347/86 |
| 6,312,115 | B1 * | 11/2001 | Hara et al. | 347/86 |
| 6,776,477 | B2 * | 8/2004 | Putman et al. | 347/84 |
| 6,959,985 | B2 * | 11/2005 | Steinmetz et al. | 347/86 |
| 7,347,541 | B2 * | 3/2008 | Ogawa et al. | 347/86 |
| 2005/0264621 | A1 | 12/2005 | Ogawa et al. | |

FOREIGN PATENT DOCUMENTS

| | | | |
|---|---|---|---|
| CN | 203567362 | U | 4/2014 |
| EP | 0589540 | B1 | 10/1997 |
| EP | 0633138 | B1 | 1/1998 |
| EP | 0646465 | B1 | 7/1999 |
| JP | 2000-033715 | A | 2/2000 |
| JP | 2000-079701 | A | 3/2000 |
| JP | 2001-105621 | A | 4/2001 |

* cited by examiner

*Primary Examiner* — Anh T. N. Vo
(74) *Attorney, Agent, or Firm* — Canon USA, Inc., IP Division

(57) ABSTRACT

A ink tank includes a casing having a partition wall configured to divide from each other an absorber storage chamber for storing an absorber capable of retaining ink and an ink storage chamber for storing ink to be supplied to the absorber storage chamber, and an ink supply port provided at the bottom surface of the absorber storage chamber and configured to supply the ink in the absorber storage chamber to an outside, wherein the sectional configuration when the absorber storage chamber is cut by a plane parallel to the partition wall and passing through the ink supply port is substantially T-shaped.

42 Claims, 14 Drawing Sheets

INK TANK

BACKGROUND OF THE INVENTION

1. Field of the Invention

The present disclosure relates to an ink tank for use in an inkjet printer configured to perform recording by discharging ink or the like onto a recording medium.

2. Description of the Related Art

Among the ink tanks used in inkjet printers, there is known a replacement type ink tank, which is detachably attachable to a carriage equipped with a recording head.

Among the replacement type ink tanks, there is known a complex-type ink tank having the inner space thereof divided by a partition wall into an absorber storage chamber storing an ink absorber and an ink storage chamber directly storing ink. For example, Japanese Patent Application Laid-Open No. 2001-105621 discusses such a complex-type ink tank.

The construction of the conventional ink tank discussed in Japanese Patent Application Laid-Open No. 2001-105621 will be briefly described.

The ink tank discussed in Japanese Patent Application Laid-Open No. 2001-105621 has a rectangular parallelepiped casing and, as illustrated in the sectional view of FIG. 12, is further equipped with an absorber storage chamber A1 and an ink storage chamber A2 adjacent to the absorber storage chamber A1. On top of the absorber storage chamber A1, there is provided an atmosphere communicating port A5, and, in the lower portion of the absorber storage chamber A1, there is provided a supply port A6 for supplying ink to a recording head. The absorber storage chamber A1 and the ink storage chamber A2 are divided from each other by a partition wall A3, and the absorber storage chamber A1 and the ink storage chamber A2 communicate with each other via a communicating portion A4 formed near the bottom portion of the partition wall A3. Further, inside the absorber storage chamber A1 discussed in Japanese Patent Application Laid-Open No. 2001-105621, there are stored two absorbers of an lower-layer absorber A12 and an upper-layer absorber A11 so as to be superimposed one upon the other in the height direction when the ink tank is in the attitude of use.

In the complex-type ink tank as discussed in Japanese Patent Application Laid-Open No. 2001-105621, even in the state in which no ink can be supplied from the ink supply port (the used-up state of the ink tank), a part of residual ink remains unused near the bottom surface of the absorber storage chamber, which is likely to result in a reduction in the ink utilization ratio of the ink tank. On the other hand, in such a conventional complex-type ink tank, sufficient examination cannot be said to have been made regarding the residual ink amount in the used-up state, leaving room for an improvement in terms of the ink utilization ratio of the ink tank.

SUMMARY OF THE INVENTION

The present invention is directed to a complex-type ink tank involving a smaller residual ink amount in the used-up state.

(1) According to a first aspect, an ink tank includes: a casing having a partition wall configured to divide from each other an absorber storage chamber for storing an absorber capable of retaining ink and an ink storage chamber for storing ink to be supplied to the absorber storage chamber, wherein the absorber storage chamber has a bottom surface having an ink supply port for supplying the ink in the absorber storage chamber to an outside, a top surface opposite the bottom surface, a first side surface serving also as one surface of the partition wall, a second side surface opposite the first side surface, and a third side surface and a fourth side surface connecting the first side surface and the second side surface and opposite to each other, wherein the width of the bottom surface is smaller than the width of the top surface in a width direction orthogonal to a longitudinal direction in which the absorber storage chamber, the partition wall, and the ink storage chamber are arranged in this order, and wherein at least one of the third side surface and the fourth side surface is provided with a step so that the distance between the third side surface and the fourth side surface in the width direction is smaller on the bottom surface side than on the top surface side.

According to a first modification aspect, there is provided an ink tank according to the first aspect of the present invention, wherein the step is provided on both the third side surface and the fourth side surface.

According to a second modification aspect, each of the third side surface and the fourth side surface may have an upper portion connected to the top surface, a lower portion connected to the bottom surface, and a step portion connecting the upper portion and the lower portion such that the step is formed between the upper portion and the lower portion. The second modification aspect may also be combined with the first modification aspect.

According to a third modification aspect, when the absorber storage chamber is cut by a plane containing the step portion of the third side surface and the step portion of the fourth side surface, the volume of an upper space formed by the top surface, the upper portion of the first side surface, the upper portion of the second side surface, the upper portion of the third side surface, and the upper portion of the fourth side surface, can be larger than the volume of a lower space formed by the bottom surface, the lower portion of the first side surface, the lower portion of the second side surface, the lower portion of the third side surface, and the lower portion of the fourth side surface. The third modification aspect may be combined with the second modification aspect.

According to a fourth modification aspect, there is provided an ink tank according to the first aspect, wherein at least one of the third side surface and the fourth side surface can have an upper portion connected to the top surface, a lower portion connected to the bottom surface, and a step portion connecting the upper portion and the lower portion such that the step is formed between the upper portion and the lower portion.

According to a fifth modification aspect, the step portion is opposite the top surface and can extend from the first side surface to the second side surface. The fifth modification aspect may be combined with one of the second through fourth modification aspects.

According to a sixth modification aspect, the absorber has an absorber upper portion above the step portion and an absorber lower portion below the step portion, wherein, in the width direction, the width of the absorber lower portion can be smaller than the width of the absorber upper portion. The sixth modification aspect may be combined with one of the second through fifth modification aspects.

According to a seventh modification aspect, the casing has a communicating port establishing communication between the absorber storage chamber and the ink storage chamber, wherein the partition wall has an atmosphere introducing groove extending from the communicating port toward the top surface side, wherein the absorber upper portion and the absorber lower portion are made of separate members, wherein the interface between the absorber upper portion and the absorber lower portion is situated above the step portion, and wherein the step portion can be situated above an upper end of the atmosphere introducing groove. The seventh modification aspect may be combined with the sixth modification aspect.

According to an eighth modification aspect, the absorber lower portion can be formed by a plurality of layers including a plurality of absorbers. The eighth modification aspect may be combined with the seventh modification aspect.

According to a ninth modification aspect, when the absorber upper portion and the step portion are projected onto the same plane along a direction orthogonal to the bottom surface, a part of the absorber upper portion can overlap the step portion. The ninth modification aspect can be combined with one of the sixth through eighth modification aspects.

According to a tenth modification aspect, the absorber storage chamber is equipped with a rib or a groove extending from the bottom surface side toward the top surface side on at least one of the first side surface, the second side surface, the third side surface, and the fourth side surface, wherein a lower end of the rib or the groove is arranged above the step portion. The tenth modification aspect may be combined with one of the second through ninth modification aspects.

According to an eleventh modification aspect, the width in the width direction of the ink storage chamber can be larger than the width in the width direction of the bottom surface side of the absorber storage chamber. The eleventh modification aspect may be combined with one of the first aspect of the present invention and the first through tenth modification aspects thereof.

According to a twelfth modification aspect, the width in the width direction of the ink storage chamber can be substantially equal to the width in the width direction of the top surface side of the absorber storage chamber. The twelfth modification aspect may be combined with one of the first aspect of the present invention and the first through eleventh modification aspects thereof.

According to a thirteenth modification aspect, the sectional configuration when the ink storage chamber is cut by a plane parallel to the partition wall can be substantially rectangular. The thirteenth modification aspect may be combined with one of the first aspect of the present invention and the first through twelfth modification aspects thereof.

According to a fourteenth modification aspect, the sectional configuration when the absorber storage chamber is cut by a plane parallel to the partition wall and passing through the ink supply port can be substantially T-shaped. The fourteenth modification aspect may be combined with one of the second through thirteenth modification aspects.

According to a fifteenth modification aspect, the sectional configuration when the absorber stored in the absorber storage chamber is cut by a plane parallel to the partition wall and passing through the ink supply port can be substantially T-shaped. The fifteenth modification aspect may be combined with the fourteenth modification aspect.

According to a sixteenth modification aspect, the sectional configuration when the absorber storage chamber is cut by a plane parallel to the partition wall and passing through the ink supply port can be substantially reverse L-shaped. The sixteenth modification aspect may be combined with one of the fourth through thirteenth modification aspects.

According to a seventeenth modification aspect, the sectional configuration when the absorber stored in the absorber storage chamber is cut by a plane parallel to the partition wall and passing through the ink supply port can be substantially reverse L-shaped. The seventeenth modification aspect may be combined with the sixteenth modification aspect.

(2) According to a second aspect, an ink tank includes: a casing having a partition wall configured to divide from each other an absorber storage chamber for storing an absorber capable of retaining ink and an ink storage chamber for storing ink to be supplied to the absorber storage chamber, and an ink supply port provided at the bottom surface of the absorber storage chamber and configured to supply the ink in the absorber storage chamber to an outside, wherein the sectional configuration when the absorber storage chamber is cut by a plane parallel to the partition wall and passing through the ink supply port is substantially T-shaped.

According to an eighteenth modification aspect, the sectional configuration when the absorber stored in the absorber storage chamber is cut by a plane parallel to the partition wall and passing through the ink supply port can be substantially T-shaped. The eighteenth modification aspect may be combined with the second aspect of the present invention.

(3) According to a third aspect, an ink tank includes: an absorber storage chamber equipped with an ink supply port and an atmosphere communicating port and storing inside an absorber capable of retaining ink; an ink storage chamber configured to store ink to be supplied to the absorber storage chamber; and a partition wall dividing from each other the absorber storage chamber and the ink storage chamber and equipped with a communicating port establishing communication between the absorber storage chamber and the ink storage chamber and an atmosphere introducing port extending upwardly from the communicating port, wherein the absorber stored in the absorber storage chamber has a plurality of layers stacked together in a vertical direction in an attitude of use of the ink tank, wherein a side surface constituting the absorber storage chamber has, above an upper end of the atmosphere introducing port, a step portion outwardly expanding in a direction orthogonal to the vertical direction, and wherein, in the state in which the absorber has been inserted into the absorber storage chamber, when viewed along the vertical direction, of the absorber having the plurality of layers, a part of an absorber layer situated above the step portion overlaps the step portion.

(4) According to a fourth aspect, an ink tank includes: a casing having a partition wall configured to divide from each other (A) an absorber storage chamber for storing an absorber capable of retaining ink and (B) an ink storage chamber for storing ink to be supplied to the absorber storage chamber, and an ink supply port configured to supply the ink in the absorber storage chamber to an outside, wherein a lower surface constituting a part of an outer surface of the casing has a plurality of groove portions provided on both sides of the ink supply port and extended along a longitudinal direction in which the absorber storage chamber, the partition wall, and the ink storage chamber are arranged in this order.

In the ink tank according to the aspects of the present disclosure and the modification aspects thereof, a step structure is provided on a side surface of the absorber storage chamber, whereby it is possible to reduce the bottom surface area of the ink tank having the ink supply port while securing a sufficient volume for the absorber storage chamber. Thus, when the ink tank has been used up, the ink residual amount near the bottom surface of the ink tank is reduced, making it possible to realize an ink tank of high ink utilization ratio.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

1. First Exemplary Embodiment

1-1. Basic Construction of the Ink Tank

Figure 1A:
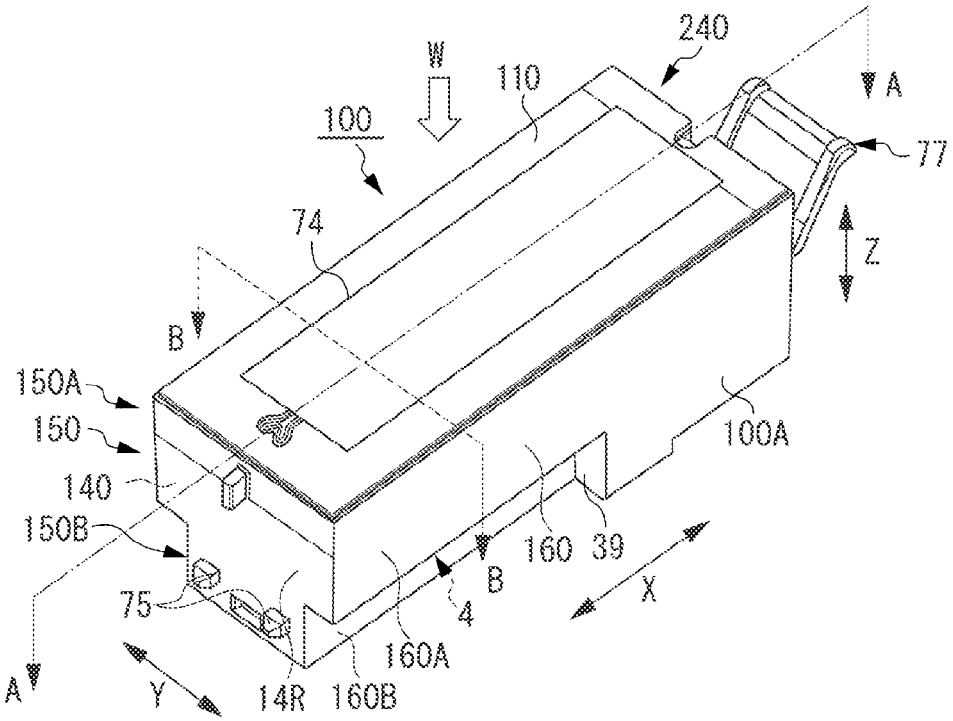
FIG. 1A is a conceptual perspective view, as seen from above, of an ink tank according to a first exemplary embodiment of the present invention.
Figure 1B:
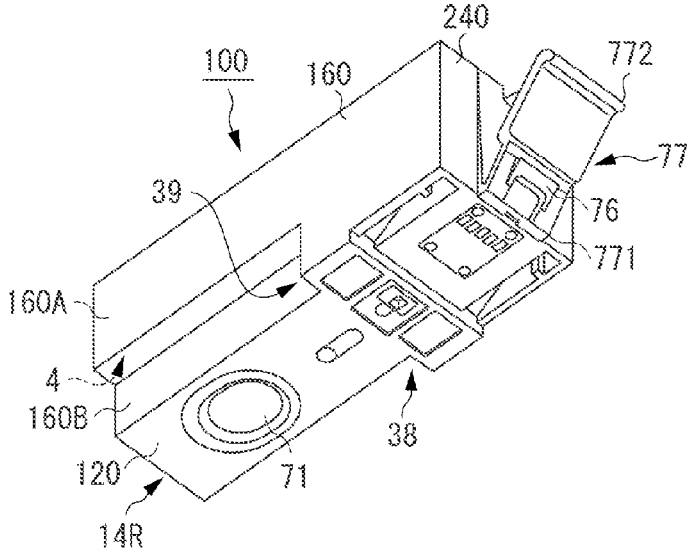
FIG. 1B is a conceptual perspective view, as seen from below, of the ink tank.

FIG. 1A is a perspective view, as seen obliquely from above (from the cover portion side), of the ink tank in the attitude of use, and FIG. 1B is a perspective view, as seen obliquely from below (from the bottom surface side), of the ink tank in the attitude of use. In the present specification, the expression: "the attitude of use of the ink tank" means the attitude of the ink tank when it has been attached to a tank holder serving as an ink attachment portion of an inkjet printer. In the attitude in which the ink tank has been attached to the carriage, the vertical direction will be referred to as the height direction Z of the ink tank.

In the following, the outer configuration of an ink tank 100 according to the present exemplary embodiment will b described.

The external frame of the ink tank 100 according to the present exemplary embodiment is formed by a casing 100A of a substantially rectangular parallelepiped configuration. The casing 100A is mainly equipped with a bottom surface portion 120, a top surface portion 110 opposite the bottom surface portion 120, and four side surface portions 140, 240, 150, and 160 connecting the bottom surface portion 120 with the top surface portion 110. The top surface portion 110 functions as a cover portion. The bottom surface portion 120 is provided with a supply port 71. In the following, the side surface portion 140 will also be referred to as the back surface portion, the side surface portion 240 will also be referred to as the front surface portion, the side surface portion 150 will also be referred to as the side-surface first-portion, and the side surface portion 160 will also be referred to as the side-surface second-portion. In the present exemplary embodiment, the front surface portion (side surface portion) 240 is of a double-layer structure, and is composed of two plate-like members 2401 and 2402 substantially parallel to each other. A space 2403 communicating with the atmosphere is formed between the plate-like members 2401 and 2402.

When it is said that the casing 100A is substantially of a rectangular parallelepiped configuration, it means that the casing is of a rectangular parallelepiped configuration, or of a partially cutout or partially protruding rectangular parallelepiped configuration. Further, as described below, each of the top surface portion 110, the bottom surface portion 120, and the side surface portions 140, 240, 150, and 160, is equipped with an inner surface facing the interior of the ink tank 100 and an outer surface facing the exterior thereof.

As illustrated in FIGS. 1A and 1B, on the back surface portion 140 side (the absorber storage chamber side described below), the side-surface first-portion 150 of the casing 100A is equipped with a side-surface first-portion upper-portion 150A situated on the upper side in the height direction Z, and a side-surface first-portion lower-portion 150B situated on the lower side in the height direction. The side-surface first-portion lower-portion 150B is arranged substantially parallel to the side-surface first-portion upper-portion 150A, and is situated on the inner side of the side-surface first-portion upper-portion 150A. On the other hand, like the side-surface first-portion 150, on the back surface portion 140 side (the absorber storage chamber side), the side-surface second-portion 160 of the casing 100A is equipped with a side-surface second-portion upper-portion 160A, and a side-surface second-portion lower-portion 160B. The side-surface second-portion lower-portion 160B is situated on the inner side of the side-surface second-portion upper-portion 160A.

The back surface portion 140 is provided with a protruding first engagement portion 75 capable of being engaged with a recessed first lock portion (not illustrated) provided in a tank holder (not illustrated). The first engagement portion 75 is provided at two positions spaced away from each other in the width direction (the lateral direction Y) of the ink tank 100. Further, on the outer surface of the front surface portion 240

Figure 2A:
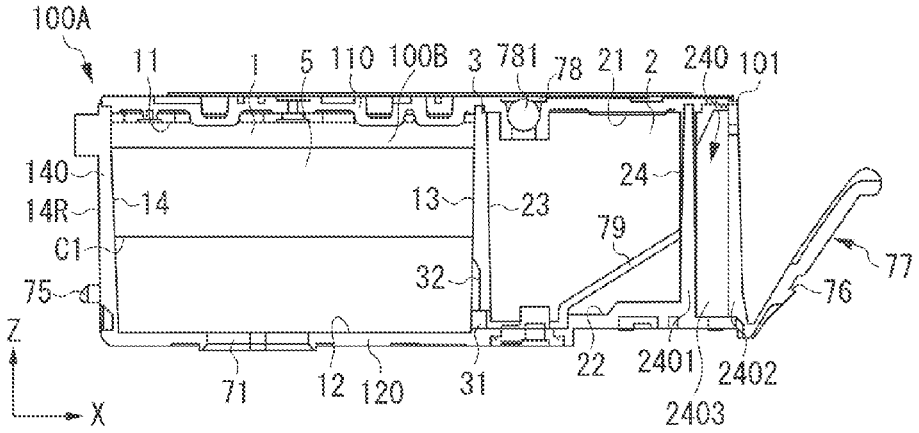
FIG. 2A is a conceptual sectional view, taken along the line A-A in FIG. 1A, of the ink tank.

(the member 2402), there is provided a latch lever 77 functioning as an elastically deformable engagement lever. As illustrated in FIG. 2A, one end portion 771 of the latch lever 77 is provided on the front surface portion 240, and the other end portion 772 of the latch lever 77 is formed as a free end spaced away from the front surface portion 240. Further, the latch lever 77 is provided with a claw-like second engagement portion 76 capable of being engaged with a recessed lock portion (not illustrated) provided in the carriage. The first engagement portion 75 is engaged with the first lock portion, and the second engagement portion 76 is engaged with the second lock portion, whereby the attachment of the ink tank 100 to the tank holder is secured.

An ink supply port (discharge port) 71 provided at the bottom surface portion 120 serves to supply (discharge) the ink in the ink tank 100 to the outside. An ink introducing tube provided on the tank holder is inserted into the ink supply port (discharge port) 71, and the ink in the ink tank 100 is supplied to a recording head (not illustrated) via the ink introducing tube.

In the following, the basic internal structure of the ink tank according to the present exemplary embodiment will be described with reference to FIGS. 1C, 2A, and 2B.

Figure 1C:
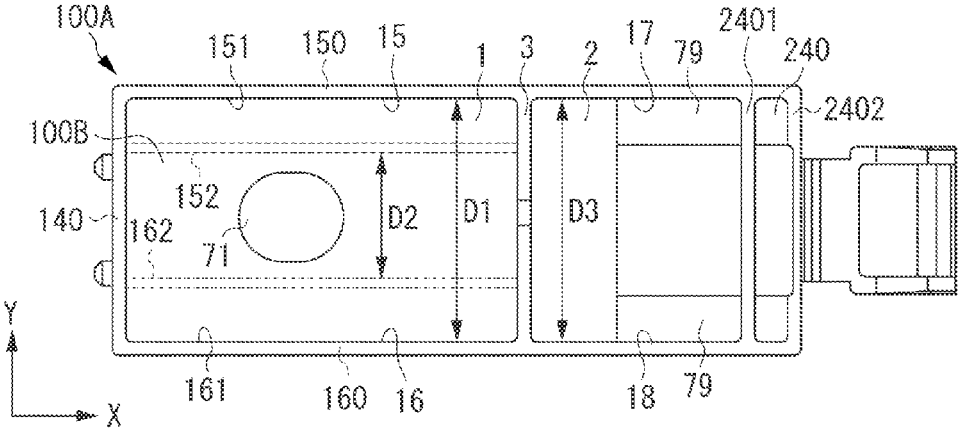
FIG. 1C is a conceptual diagram illustrating the positional relationship between the components when the ink tank is projected from the direction of the arrow W in FIG. 1A.

FIG. 1C is a projection view in which the components of the ink tank are projected from the direction of the arrow W in FIG. 1A. FIG. 2A is a sectional view taken along the line A-A in FIG. 1A (section taken along a plane perpendicularly crossing the lateral direction Y). FIG. 2B is a sectional view taken along the line B-B in FIG. 1A (section taken along a plane perpendicularly crossing the longitudinal direction X).

As illustrated in FIGS. 1C and 2A, the casing 100A is provided with a partition wall 3 for dividing the inner space 100B of the casing 100A into two chambers (an absorber storage chamber 1 and an ink storage chamber 2). The absorber storage chamber 1 serves to store an absorber 5 capable of retaining ink, and the ink storage chamber 2 serves to store ink to be supplied to the absorber storage chamber 1.

The partition wall 3 is a plate-like member substantially perpendicular to the two side surface portions (150 and 160) and substantially parallel to the back surface portion 140 and the front surface portion 240 (members 2401 and 2402). By providing the partition wall 3, the absorber storage chamber 1 is formed on the back surface portion 140 side, and the ink storage chamber 2 is formed on the front surface portion 240 side. That is, the absorber storage chamber 1, the partition wall 3, and the ink storage chamber 2 are arranged in that order within the casing 100A of the ink tank 100. This arrangement order (arrangement direction) will be defined as the longitudinal direction X of the ink tank 100. The lateral direction (width direction) Y is perpendicular to both the longitudinal direction X and the height direction Z.

The absorber 5 is stored in the absorber storage chamber 1, and ink is retained by the absorber 5. Further, the supply port 71 is provided at the bottom surface 12 (the bottom surface portion 120) of the absorber storage chamber 1. On the other hand, stored in the ink storage chamber 2 is the ink with which the absorber 5 inside the absorber storage chamber 1 is to be supplied (replenished), and the ink inside the ink storage chamber 2 is supplied to the absorber storage chamber 1 via a communicating portion (communicating port) 31.

More specifically, when the ink retained by the absorber 5 in the absorber storage chamber is supplied to the outside via the supply port 71, the ink inside the ink storage chamber 2 is supplied to the absorber storage chamber 1 via the communicating port 31. The absorber storage chamber 1 side surface of the partition wall 3 (the first side surface 13 described below) is provided with a plurality of grooves (atmosphere communicating grooves) 32 extending in the vertical direction (Z-direction). These atmosphere communicating grooves 32 extend upwards from the communicating port 31 below, and function as the atmosphere communicating paths for promoting the introduction of atmospheric air into the ink storage chamber 2 at the time of ink supply operation. By providing the atmosphere communicating paths (atmosphere communicating grooves 32) between the partition wall 3 and the absorber 5, air is enabled to come and go more smoothly between the absorber storage chamber 1 and the ink storage chamber 2. As a result, it is possible to promote the introduction of atmospheric air into the ink storage chamber 2 (adjust the internal air pressure) at the time of ink supply operation.

Figure 3:
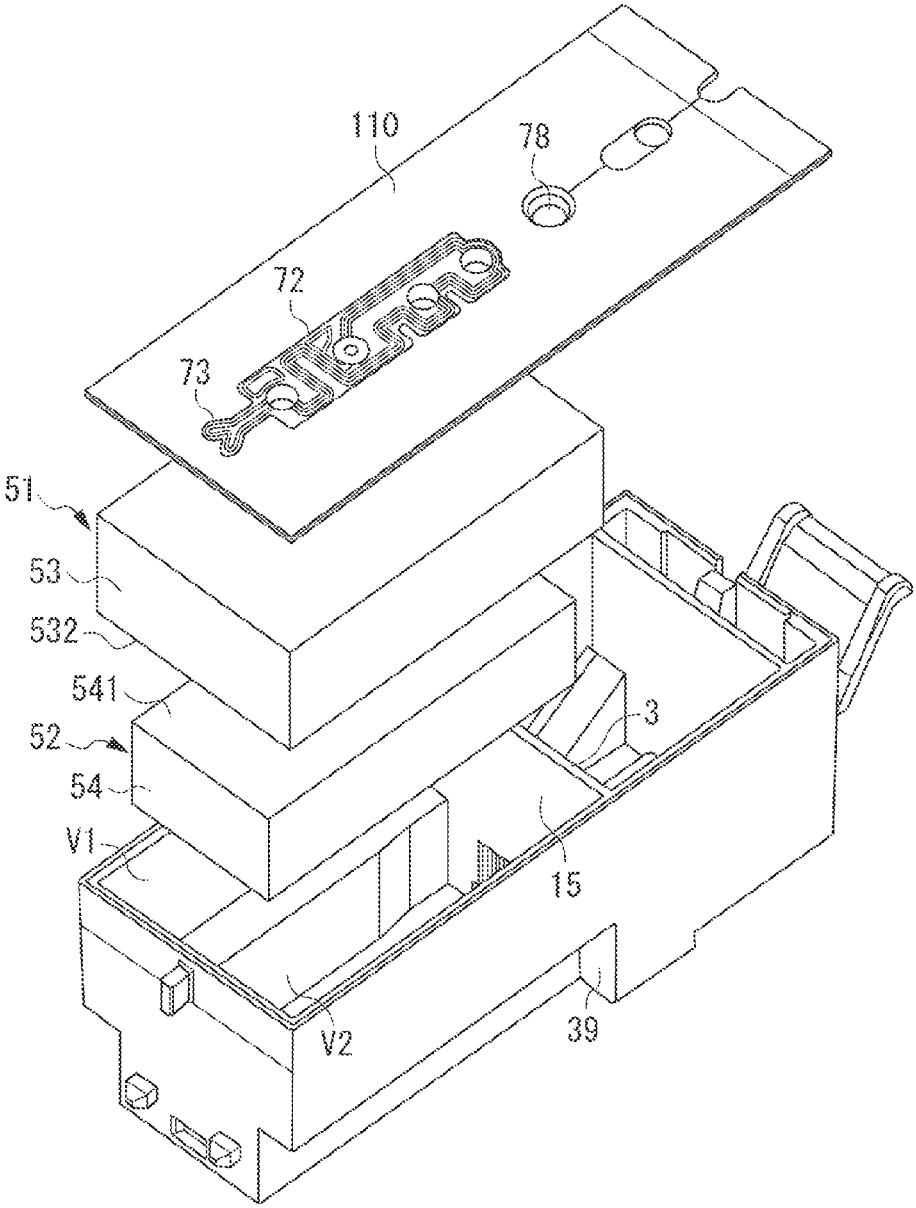
FIG. 3 is a conceptual perspective view illustrating the state prior to the assembly of the ink tank (the insertion of an absorber) according to the first exemplary embodiment.

Further, the top surface portion (cover portion) 110 of the ink tank 100 according to the present exemplary embodiment is provided with an atmosphere communicating port 73 for taking air into the ink tank 100 when supplying ink. More specifically, as illustrated in FIG. 3, the top surface portion 110 has an atmosphere communicating groove (detour groove) 72 establishing communication between the interior and the exterior of the ink tank 100, and the atmosphere communicating groove 72 is covered with a seal 74 (illustrated in FIG. 1A) except for the opening portion. On the other hand, the atmosphere communicating port 73 is formed by the opening portion of the atmosphere communicating groove 72, and evaporation of the ink in the ink tank 100 is suppressed by the atmosphere communicating port 73 (the atmosphere communicating groove 72), with the pressure equilibrium between the interior and exterior of the ink tank 100 being adjusted.

1-2. Absorber Storage Chamber

In the following, the absorber storage chamber 1 and the step (step configuration) thereof will be described.

Figure 2B:
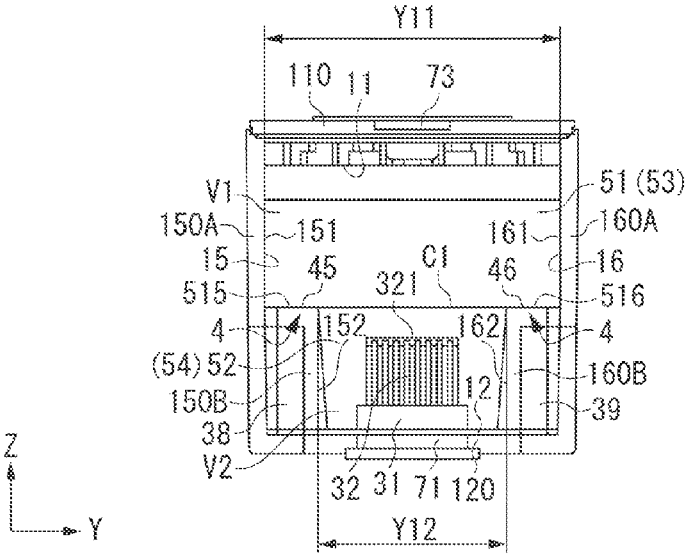
FIG. 2B is a conceptual sectional view, taken along the line B-B in FIG. 1A, of the ink tank.

As illustrated in FIG. 1C, 2A, or 2B, inside the casing 100A, the absorber storage chamber 1 of the ink tank 100 according to the present exemplary embodiment is formed between the back surface portion 140 and the partition wall 3. The absorber storage chamber 1 is equipped with a top surface 11 and a bottom surface 12 opposite each other, a first side surface 13 and a second side surface 14 opposite each other, and a third side surface 15 and a fourth side surface 16 connecting the first side surface and the second side surface and opposite each other.

The bottom surface 12 is formed by the inner surface of the bottom surface portion 120, and the top surface 11 is formed by the inner surface of the top surface portion 110. Further, the first side surface 13 serves also as one surface of the partition wall 3, and the second side surface 14 serves also as the inner side surface of the back surface portion 140. The third side surface 15 serves also as the inner surface of the side-surface first-portion 150, and the fourth side surface 16 serves also as the inner surface of the side-surface second-portion 160.

The third side surface 15 and the fourth side surface 16 are respectively equipped with an upper portion 151 (the inner surface of an upper portion 150A of the side-surface first-portion 150) and an upper portion 161 (the inner surface of an upper portion 160A of the side-surface second-portion 160) connected with the top surface 11, and a lower portion 152 (the inner surface of a lower portion 150B of the side-surface first-portion) and a lower portion 162 (the inner surface of a lower portion 160B of the side-surface second-portion 160) connected with the bottom surface 12.

As illustrated in FIG. 2B, the third side surface 15 is provided with a step portion 45 connecting the upper portion 151 and the lower portion 152, and a step 4 is formed between the upper portion 151 and the lower portion 152. On the other hand, the fourth side surface 16 is provided with a step portion 46 connecting the upper portion 161 and the lower portion 162, and the step 4 is formed between the upper portion 161 and the lower portion 162.

More specifically, the upper portion 151 and the lower portion 152 of the third side surface are substantially parallel, and the step portion 45 is substantially perpendicular to both the upper portion 151 and the lower portion 152, with the upper portion 151 and the lower portion 152 being connected via the step portion 45. On the other hand, as with the third side surface, the upper portion 161 and the lower portion 162 of the fourth side surface are also substantially parallel, and the step portion 46 is substantially parallel to both the upper portion 161 and the lower portion 162, with the upper portion 161 and the lower portion 162 being connected via the step portion 46. The step portions 45 and 46 forming the step 4 are opposite the top surface 11 and extend from the first side surface 13 to the second side surface 14, connecting the partition wall 3 and the back surface portion 140.

As illustrated in FIGS. 1A and 1B, when viewed from the outside of the casing 100A, the steps 4 formed on the side surfaces 15 and 16 are formed between the outer surface of the back surface portion 140 (the back surface of the second side surface 14) 14R and auxiliary surfaces 38 and 39 substantially parallel to the outer surface 14R. As illustrated in FIG. 3, the auxiliary surfaces 38 and 39 are formed to be substantially flush with the first side surface 13 of the partition wall 3.

The upper portion 151 of the third side surface 15 and the upper portion 161 of the fourth side surface 16 are provided so as to be opposite each other, and the lower portion 152 of the third side surface 15 and the lower portion 162 of the fourth side surface 16 are provided so as to be opposite each other. Further, the lower portions 152 and 162 are formed so as to be situated further on the inner side of the ink tank than the upper portions 151 and 161, so that the distance (D2) between the lower portions 152 and 162 opposite each other is smaller than the distance (D1) between the upper portions 151 and 161 opposite each other. That is, the distance between the third side surface 15 and the fourth side surface 16 in the width direction Y is set such that the bottom surface side distance (D2) is smaller than the top surface side distance (D1). As a result, in the width direction Y orthogonal to the longitudinal direction X of the ink tank 100, the width (Y12) of the bottom surface 12 is smaller than the width (Y11) of the top surface 11.

In other words, the upper portions (151 and 161) of the third side surface 15 and the fourth side surface 16 expand further outwards in the width direction than the lower portions (152 and 162) thereof. The sectional configuration of the absorber storage chamber 1 when it is cut by a plane parallel to the partition wall 3 and passing through the ink supply port 71 (the section taken along the line B-B in FIG. 1A) is substantially T-shaped as illustrated in FIG. 2B.

In the longitudinal direction X, the top surface 11 and the bottom surface 12 are of the same length, so that the area of the bottom surface 12 of the absorber storage chamber 1 of the ink tank 100 is smaller than the area of the top surface 11 thereof. Thus, as compared with an ink tank having a top surface and a bottom surface of the same area, the amount of ink remaining at the bottom surface of the ink tank is suppressed, thereby achieving an improvement in terms of ink utilization ratio.

As illustrated in FIG. 2B, using a plane including the step portion 45 of the third side surface 15 and the step portion 46 of the fourth side surface 16 as the interface, the absorber storage chamber 1 can be divided in the height direction Z into two upper and lower absorber storage portions (a first absorber storage portion V1 and a second absorber storage portion V2).

The first absorber storage portion V1 has an upper space (V1) defined by the top surface 11, the upper portion of the first side surface 13, the upper portion of the second side surface 14, the upper portion (151) of the third side surface 15, and the upper portion (161) of the fourth side surface 16. On the other hand, the second absorber storage portion V2 has a lower space (V2) defined by the bottom surface 12, the lower portion of the first side surface 13, the lower portion of the second side surface 14, the lower portion (152) of the third side surface 15, and the lower portion (162) of the fourth side surface 16.

In the ink tank 100 according to the present exemplary embodiment, the volume of the first absorber storage portion V1 is larger than that of the second absorber storage portion v2.

As a result, it is possible to reduce solely the area of the bottom surface 12 of the second absorber storage portion V2 situated at the lower stage without reducing the volume of the first absorber storage portion V1 situated at the upper stage of the ink tank 100. Thus, it is possible to maintain the ink storage amount of the ink tank 100 and, at the same time, to reduce the amount of ink remaining in the vicinity of the bottom surface 12 when the ink tank has been used up.

Further, as illustrated in FIG. 1C, the bottom surface 12 is situated between the step portions 45 and 46 (at the central portion), and is situated below the step portions 45 and 46. Thus, the ink inside the absorber storage chamber is likely to flow (gather) to the ink supply port 71 provided at the bottom surface 12, with the result that the amount of residual ink in the ink tank 100 is diminished.

As illustrated in FIG. 1C or FIG. 2A, the ink storage chamber 2 according to the present exemplary embodiment is equipped with a top surface 21 and a bottom surface 22 opposite to each other, a fifth side surface 23 and a sixth side surface 24 opposite each other, and a seventh side surface 17 and an eighth side surface 18 connecting the fifth side surface 23 and the sixth side surface 24 and opposite each other. The fifth side surface 23 serves also as the back surface of the first side surface 13 of the partition wall 3, and the sixth side surface 24 serves also as the inner surface of the plate-like member 2401 of the front surface portion 240.

As illustrated in FIG. 2A, the top surface 21 of the ink storage chamber 2 constitutes the inner surface of the top surface portion 110 together with the top surface 11 of the absorber storage chamber 1, and the bottom surface 22 of the ink storage chamber 2 constitutes the inner surface of the bottom surface portion 120 together with the bottom surface 12 of the absorber storage chamber 1. Further, as illustrated in FIG. 1C, the seventh side surface 17 constitutes the inner surface of the side-surface first-portion 150 together with the third side surface 15 of the absorber storage chamber 1, and the eighth side surface 18 constitutes the inner surface of the side-surface second-portion 160 together with the fourth side surface 16 of the absorber storage chamber 1.

When, as in the present exemplary embodiment, the absorber storage chamber 1 is divided into the to upper and lower absorber storage portions (V1 and V2), and the width of the lower-stage absorber storage portion V2 is smaller than the width of the upper-stage absorber storage portion (V1), it is also possible to suppress the ink residual amount while achieving an increase in the volume of the ink tank.

More specifically, generally speaking, in order to achieve an increase in the ink storage amount, it might be possible to form a structure (a large volume structure) in which the casing 100A of the ink tank 100 is expanded in the depth direction (the longitudinal direction X) or in the width direction (the lateral direction Y). However, in the case where the ink tank 100 is simply expanded in the depth direction (X-direction) or in the width direction (Y-direction), the size of the absorber storage chamber 1 and that of the absorber 5 simply increase, with the result that the distance from every corner of the absorber 5 in the absorber storage chamber to the ink supply port 71 inevitably increases. As a result, the ink retained at a position far from the ink supply port 71 is more likely to be not consumed, which means that the ink use-up state tends to become worsened.

In contrast, in the present exemplary embodiment, the volume/width of the lower portion of the absorber storage chamber 1 provided with the ink supply port 71 (the second absorber storage portion V2) is smaller than the volume/width of the upper portion of the absorber storage chamber 1 (the first absorber storage portion V1). As a result, it is possible to reduce the residual amount of the ink retained at a position far from the ink supply port 71 is reduced, and it is possible for the first absorber storage portion V1 to exhibit a sufficient ink storage volume, making it possible to realize an increase in the volume of the ink tank. In the way, in the present exemplary embodiment, it is possible to suppress the ink residual amount when the ink has been used up while achieving an increase in the volume of the ink tank.

Further, in the lateral direction (width direction) Y of the casing 100A, the width Y2 of the ink storage chamber 2 is made substantially equal to the width of the first absorber storage portion V1 (the distance D between the seventh side surface 17 and the eighth side surface 18), whereby it is possible to secure a still larger volume for the ink storage chamber 2.

Further, as illustrated in FIG. 2B, in the ink tank 100 according to the present exemplary embodiment, in the attitude of use, a part of the upper portion of the absorber 5 (an absorber upper portion 51 described below) can be caused to abut on the step portions 45 and 46, and the step portions 45 and 46 can function as abutment portions described below.

Further, as illustrated in FIG. 2B and FIG. 1C, in the present exemplary embodiment, the ink supply port 71 is provided at the central portion in the width direction (the lateral direction Y) of the bottom surface 12.

Further, in the present exemplary embodiment, arrangement is made such that, when viewed along the height direction Z, at least a part of the ink supply port 71 on the bottom surface 12 overlaps a triangular region formed by connecting the positions of two engagement portions 75 on the back surface portion 140 and the position of a second engagement portion 76 on the front surface portion 240 (the member 2402). Thus, when the ink tank 100 is attached to an inkjet printer, it is possible to stably maintain the contact state (communicating state) between the absorber on the inner side of the ink supply port 71 and the ink introducing tube held in contact from the printer side.

1-3. Ink Tank Manufacturing Process

Figure 4A:
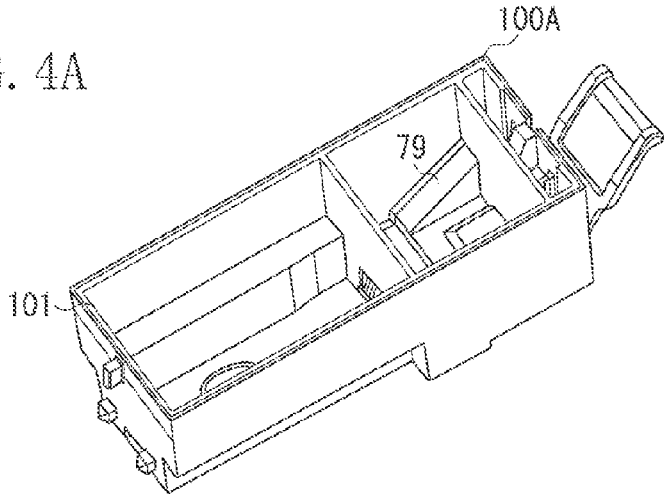
FIG. 4A is a conceptual perspective view illustrating the state in which no absorber has been inserted into the ink tank according to the first exemplary embodiment.
Figure 4B:
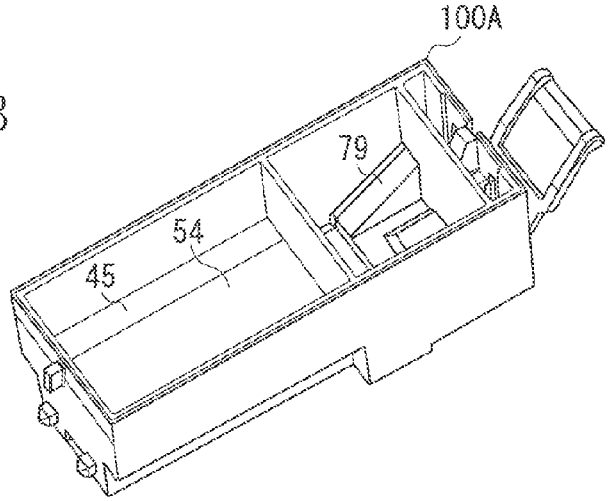
FIG. 4B is a conceptual perspective view illustrating the state in which a lower-layer absorber has been inserted into the ink tank.
Figure 4C:
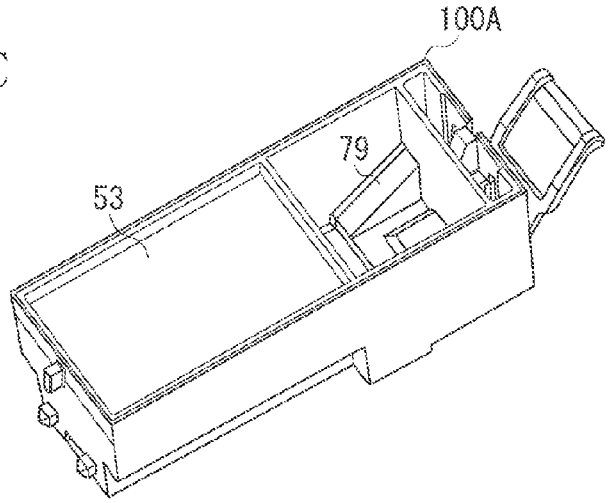
FIG. 4C is a conceptual perspective view illustrating the state in which an upper-layer absorber has been inserted into the ink tank.

FIG. 3 is a perspective view of the state prior to the assembly of the ink tank according to the present exemplary embodiment (the state prior to the insertion of the absorber 5). FIG. 4A illustrates the state in which the absorber 5 has not been inserted into the ink tank 100 yet. FIG. 4B illustrates the state in which the lower-layer absorber (absorber lower portion) 52 has been inserted into the ink tank 100. FIG. 4C illustrates the state the upper-layer absorber (absorber upper portion) 51 has been inserted into the ink tank 100.

As described above, in the present exemplary embodiment, the absorber 5 is equipped with the absorber upper portion 51 and the absorber lower portion 52 so as to be respectively in correspondence with the first absorber storage portion V1 and the second absorber storage portion V2. In the present exemplary embodiment, the absorber upper portion 51 and the absorber lower portion 52 are formed as separate members (separate bodies). The absorber upper portion 51 is formed by a first absorber (upper-layer absorber) 53 situated in the upper layer, and the absorber lower portion 52 is formed by a second absorber (lower-layer absorber) 54 situated in the lower layer. That is, the absorber 5 is formed by two absorbers stacked together in the height direction Z, thus exhibiting a double-layered structure. In the present exemplary embodiment, the absorber upper portion 51 is of a single layer structure including a single absorber (the first absorber 53), and the absorber lower portion 52 is also of a single layer structure including a single absorber (the second absorber 54).

The absorber upper portion 51 is stored in the first absorber storage portion V1, and the absorber lower portion 52 is stored in the second absorber storage portion V2. The absorber 5 stored in the absorber storage chamber 1 is of a configuration in conformity with the configurations of the bottom surface 12, the side surfaces (13, 14, 15, and 16), and the step portions 45 and 46 of the absorber storage chamber 1, so that, as illustrated in FIG. 2B, the width of the absorber upper portion 51 is larger than the width of the absorber lower portion 52. That is, as in the case of the sectional configuration of the absorber storage chamber 1, the sectional configuration of the absorber 5 when it is cut by a plane parallel to the partition wall 3 and passing through the ink supply port 71 is substantially T-shaped.

As illustrated in FIG. 3, the second absorber 54 and the first absorber 53 are sequentially inserted via the opening 101 at the top of the casing 100A, and then the casing is sealed by a cover (the top surface portion) 110.

As the method of sealing the cover (top surface portion) 110 and the casing 100A main body, ultrasonic fusion bonding is preferably adopted. Further, from the viewpoint of anti-ink-evaporation property and of resin cost, it is desirable to select polypropylene for the cover (top surface portion) 110 and the portion of the casing 100A other than the cover.

1-3-1. Preparation of the Absorber

Next, the absorber 5 to be inserted into the above-described ink tank 100 will be described.

In the present exemplary embodiment, the absorber 5 is composed of two absorbers (two absorber layers): the first absorber 53 as the absorber upper portion 51 and the second absorber 54 as the absorber lower portion 52. Regarding the respective ink retaining forces (capillary forces) of the two absorbers (the first absorber 53 and the second absorber 54), that of the second absorber 54 constituting the lower layer is stronger than that of the first absorber 53 constituting the upper layer. The absorber 5 (the first absorber 53 and the second absorber 54) is an aggregate of olefin type resin fibers. The first absorber 53 employs fibers of a fiber diameter of approximately 31 μm, and the second absorber 54 employs fibers of a fiber diameter of approximately 18 μm. In the present exemplary embodiment, the fiber density of the first absorber 53 is the same as the fiber density of the second absorber 54, so that, as compared with the first absorber 53, the second absorber 54 exhibits weaker framework rigidity, and is more subject to deformation.

The first absorber 53 and the second absorber 54 are both subject to deformation in the width direction (lateral direction Y) of the ink tank 100. When inserting the absorber 5 into the casing 100A, it is compressed in the width direction Y.

The ink retaining force of the absorber 5 can be controlled (adjusted) by the contact area between the fibers in the absorber and the ink, that is, the fiber gaps. More specifically, when fibers are employed for the ink absorber, it is possible to enhance the ink retaining force by increasing the number of fibers brought into contact with the ink by unit ink amount (i.e., by increasing the fiber density). Further, when, for example, the fiber density (fiber to ink volume ratio) is the same, it is also possible to enhance the ink retaining force by reducing the diameter of the fibers used. For example, in the case where fibers of the same kind are employed for the first absorber 53 and the second absorber 54, by making the fiber density of the second absorber 54 higher (i.e., by making the number of fibers) as compared with the first absorber 53, it is possible to make the ink retaining force of the second absorber 54 higher than that of the first absorber 53. On the other hand, apart from the method in which fibers of the same kind are used and in which the retaining force of the first absorber 53 is made different from that of the second absorber 54 by making their fiber densities (their numbers of fibers) different, it is also possible to adopt, from the viewpoint of the design of the absorber 5, a method in which the contact area is increased by making the fiber diameter of the second absorber 54 smaller than that of the first absorber 53.

1-3-2. Insertion of the Absorber

Next, the step of inserting the absorber 5 (the first absorber 53 and the second absorber 54) will be described.

FIG. 4A illustrates the state in which the absorber 5 has not been inserted into the tank 100 yet. FIG. 4B illustrates the state in which the lower layer absorber (second absorber) 54 has been inserted into the second absorber storage portion V2. FIG. 4C illustrates the state in which the upper layer absorber (first absorber) 53 has been inserted into the first absorber storage portion V1.

With respect to the casing 100A, after the second absorber 54 has been inserted into the lower-stage second absorber storage portion V2, the first absorber 53 is inserted into the upper-stage first absorber storage portion V1. A bottom surface 532 (illustrated in FIG. 3) of the first absorber 53 is in contact with a top surface 541 (illustrated in FIG. 3) of the second absorber 54, and an interface C1 (illustrated in FIGS. 2A and 2B) between the first absorber 53 and the second absorber 54 is formed by the bottom surface 532 and the top surface 541.

The dimension of the second absorber 54 is set such that, in the state in which the lower-layer absorber (second absorber 54) has been inserted into the second absorber storage portion V2, the top surface of the lower-layer absorber (second absorber 54) is of the same height as or higher than the abutment portions (step portions 45 and 46). As a result, it is possible to firmly hold the first absorber 53 and the second absorber 54 in contact with each other due to the reaction force generated through elastic deformation of the second absorber 54 when the first absorber 53 presses the second absorber 54 due to the pressing force from the cover (top surface portion) 110.

When the first absorber 53 has been inserted after the second absorber 54, the configuration of the second absorber 54 is crushed to some degree through pressure. However, when the bottom surface 532 of the first absorber 53 abuts on the abutment portions (step portions 45 and 46), further downward movement of the bottom surface 532 of the first absorber 53 is regulated. As a result, the second absorber 54 can be prevented from being crushed more than necessary.

More specifically, the bottom surface 532 of the first absorber 43 has opposing portions 515 and 516 (illustrated in FIG. 2B) respectively opposite the step portions 45 and 46 of the absorber storage chamber 1, and it is possible for the opposing portions 515 and 516 to abut on the step portions 45 and 46 (abutment portions). That is, when viewed along the height direction Z (the vertical direction) (i.e., when projected on the same plane), of the absorber 5, a part (the opposing portions 515 and 516) of the absorber layer (the first absorber 53 as the absorber upper portion 51) situated above the step portions 45 and 46 overlaps the step portions 45 and 46.

As a result, when inserting the first absorber 53 after the second absorber 54, even if an expressive pressing force is involved, the opposing portions 515 and 516 of the first absorber 53 abut on the step portions 45 and 46, so that it is possible to prevent the second absorber 54 on the lower side from being excessively compressed. Thus, as illustrated in FIG. 2B, in the height direction Z, it is possible to accurately situate the portion, where the interface C1 between the first absorber 53 and the second absorber 54 crosses the partition wall 3, to be above the upper end portion 321 of the atmosphere introducing groove 32 (the communicating port 31).

In this way, by providing the interior of the absorber storage chamber 1 with a step configuration, the step portions 45 and 46 serve as mechanical stoppers (physical support members) with respect to the upper-layer first absorber 53. Thus, independently of the strength of the lower-layer second absorber 54, there is little chance of the second absorber 54 being crushed, thus making it possible to realize stabilization of the interface C1 of the absorber. Further, it is easy to control the relative position (height) of the interface C1 inside the absorber storage chamber 1, making it possible to perform a design free from the restrictions of the conventional absorber construction.

Further, even when, at the time of transport and storage, the ink tank is left to stand in an attitude I which the ink storage chamber 2 is situated on the upper side in the gravitational direction, there is no fear of air allowed to enter the absorber storage chamber 1 via the atmosphere communicating port 73 passing through the interface C1 (i.e., it is cut off) due to the difference of not less than a predetermined level in ink retaining force between the first absorber 53 and the second absorber 54. That is, the interface C1 functions as a barrier to movement of air and liquid, so that it is possible to prevent any air having entered the absorber storage chamber from being allowed to enter the ink storage chamber 2 via the communicating port 31. Thus, the ink inside the ink storage chamber 2 undergoes no gas-liquid exchange, and there is no fear of the ink inside the ink storage chamber 2 from being unnecessarily allowed to flow into the absorber storage chamber 1. As a result, it is possible to reduce the risk of the ink leaking out of the ink tank 100 via the atmosphere communicating port 321.

While in the present exemplary embodiment the step portions 45 and 46 are formed in the same width and the same height so as to extend substantially parallel to each other, this should not be construed restrictively. For example, they may also be formed in different widths or heights. Further, instead of being formed so as to be substantially parallel to the top surface 11, it is also possible for the step portions 45 and 46 to be formed so as to be somewhat inclined (lowered) toward the central portion of the ink tank 100. In this case, the position where the planes (imaginary planes) in which the step portions 45 and 46 inclined toward the central portion exist cross each other (i.e., the position where the extensions of the imaginary planes cross each other), is situated above the upper end 321 of the atmosphere introducing groove 32. Although it is desirable for the step portions 45 and 46 to be of the same width, this should not be construed restrictively.

In the present exemplary embodiment, the step portions 45 and 46 are set at positions corresponding to substantially half the height of the casing 100A. It is also possible for the height position of the step portions 45 and 46 to be adjusted according to the ink storage volume.

The first absorber 53 and the second absorber 54 are formed in a configuration akin to the configuration of the inner surfaces of the first absorber storage portion V1 and the second absorber storage portion V2. Thus, as in the case of the first absorber storage portion V1 and the second absorber storage portion V2, it is possible for the size of the lower-layer second absorber 54 to be smaller than that of the upper-layer first absorber 53. Thus, as compared with the case where the first absorber 53 and the second absorber 54 are formed in the same width, it is possible to more reliably suppress the amount of ink remaining in the second absorber 54.

After the insertion of the absorber 5 into the absorber storage chamber 1, the cover (top surface portion) 110 is mounted to the casing 100A, whereby the assembly of the ink tank 100 according to the present exemplary embodiment is completed. As a result, it is possible to inject ink into the ink tank 100.

1-3-3. Injection of the Ink

In the following, the step of injecting ink into the ink tank 100 will be described. The ink injection step according to the present exemplary embodiment includes a first ink injection step and a second ink injection step.

In the first ink injection step, a portion of the ink (not illustrated) is first injected into the ink tank 100 via an ink injection port 78 (illustrated in FIGS. 2A and 3) provided in the cover (top surface portion) 110. More specifically, the ink injection port 78 is formed as a through-hole extending through the top surface portion 110 at the top of the ink storage chamber 2, making it possible to directly inject the ink into the ink storage chamber 2 of the ink tank 100. The ink injected into the ink storage chamber 2 flows to the absorber storage chamber 1 to be gathered therein via the communicating port 31.

On the other hand, in the second ink injection step, ink is directly injected into the absorber 5 in the absorber storage chamber 1 via the ink supply port 71.

When the total ink injection amount of the first ink injection step and the second ink injection step reaches a predetermined amount (the predetermined volume of the ink tank), the step of injecting ink into the ink tank 100 is completed.

After the ink has been injected into the ink tank 100, a small amount of ink is extracted from the ink tank via the ink supply port 71, whereby it is possible to stabilize the state of the ink injected into the absorber 5.

Further, after the injection of ink into both the absorber storage chamber 1 and the ink storage chamber 2 through the first and second ink injection steps, a plug 781 (illustrated in FIG. 2A) is mounted to the ink injection port 78, and a cap (not illustrated) for preventing scattering and evaporation of ink is mounted to the ink supply port 71. After this, the injection port 78 is covered and sealed together with the atmosphere communicating groove 72 (FIG. 3) by using a seal 74 (illustrated in FIG. 1A)

1-4. Modification 1

Next, modification 1 of the first exemplary embodiment (hereinafter simply referred to as modification 1) will be described.

Basically, modification 1 is the same as the first exemplary embodiment of the present disclosure, so a description of the portions common to modification 1 and the first exemplary embodiment will be left out. The following description will center on the differences.

As described above, in the first exemplary embodiment of the present disclosure, the step 4 (step configuration) is formed between the outer surface 14R of the back surface portion 140 (the back surface of the second side surface 14), and the auxiliary surfaces 38 and 39 substantially parallel to the outer surface 14R, and the auxiliary surfaces 38 and 39 are formed so as to be substantially flush with the first side surface 13 of the partition wall 3.

Figure 5:
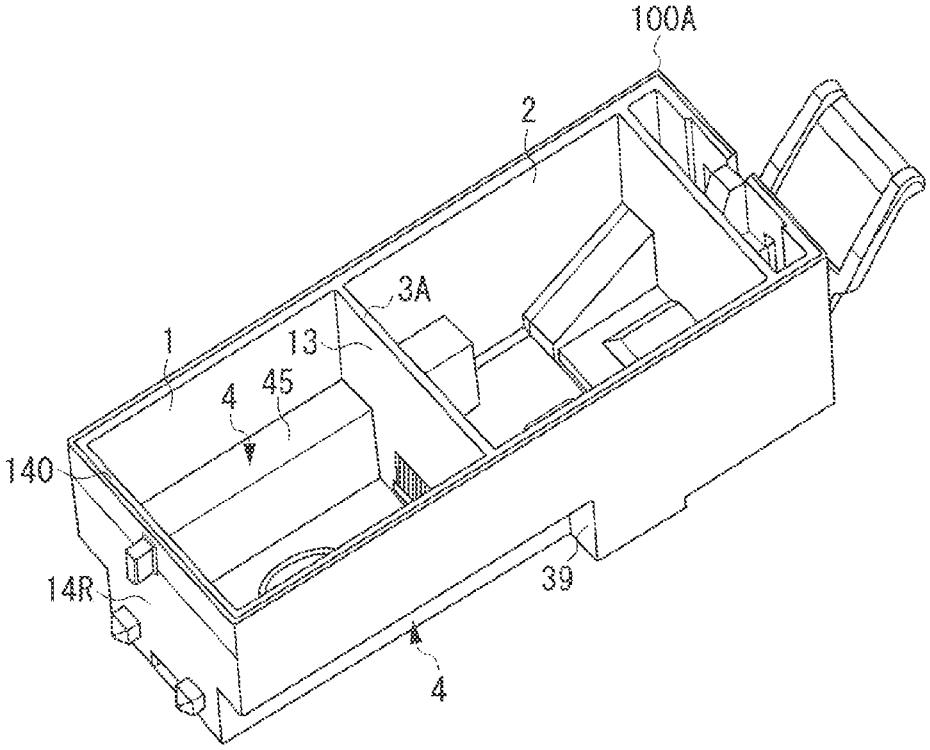
FIG. 5 is a conceptual perspective view of an ink tank according to modification example disclosure, with a cover portion removed therefrom.

In contrast, as illustrated in the conceptual sectional view of FIG. 5, in modification 1, the step 4 is formed between the outer surface 14R and the auxiliary surfaces 38 and 39, whereas the auxiliary surfaces 38 and 39 are formed at positions different from the first side surface 13 of a partition wall 3A. That is, the step 4 continues from the back surface portion 140 side to the auxiliary surface 38 and 39 side, whereas the partition wall 3A is arranged at a position closer to the back surface portion 140 side as compared with the auxiliary surfaces 38 and 39.

As a result, in modification 1, the volume of the absorber storage chamber 1 is smaller than that of the first exemplary embodiment, whereas the volume of the ink storage chamber 2 is increased. As in the case of the first exemplary embodiment, modification 1 is formed such that the area of the bottom surface 12 of the absorber storage chamber 1 is smaller than the area of the top surface 11 thereof. Thus, as compared with the ink tank whose top surface and bottom surface are of the same area, the amount of ink remaining at the bottom surface of the ink tank is suppressed, whereby an improvement is achieved in terms of ink utilization ratio.

1-5. Modification 2

Next, modification 2 of the first exemplary embodiment (hereinafter simply referred to as modification 2) will be described.

Basically, modification 2 is the same as the first exemplary embodiment of the present disclosure, so a description of the portions common to modification 2 and the first exemplary embodiment will be left out. The following description will center on the differences.

As described above, in the first exemplary embodiment of the present disclosure, the step 4 (step configuration) is formed between the outer surface 14R of the back surface portion 140 (the back surface of the second side surface 14), and the auxiliary surfaces 38 and 39 substantially parallel to the outer surface 14R, and the auxiliary surfaces 38 and 39 are formed so as to be substantially flush with the first side surface 13 of the partition wall 3.

Figure 6:
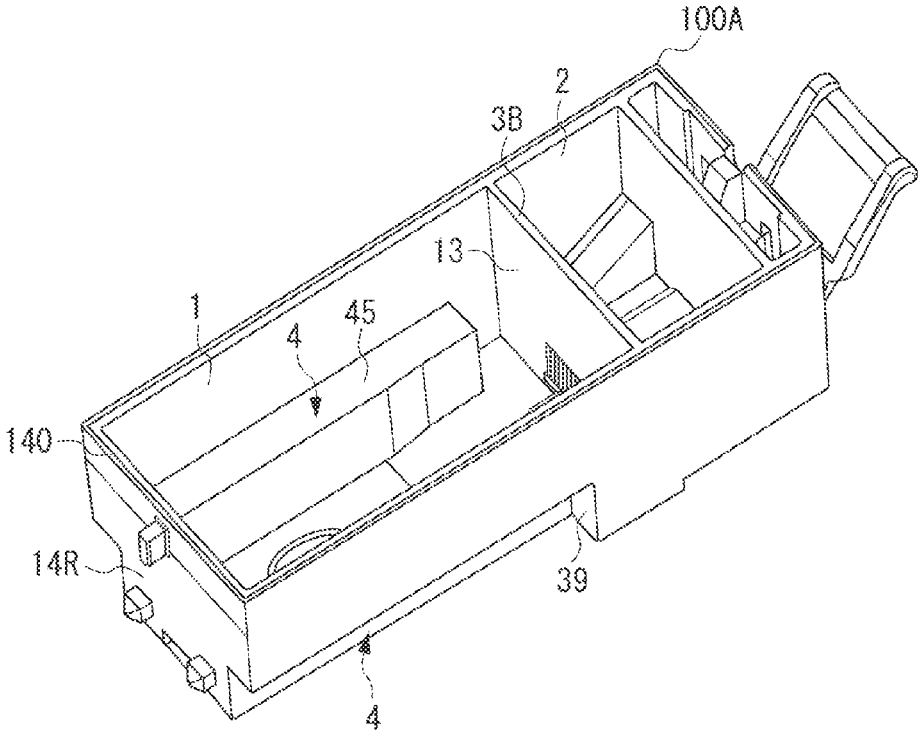
FIG. 6 is a conceptual perspective view of an ink tank according to modification example disclosure, with the cover portion removed therefrom.

In contrast, as illustrated in the conceptual sectional view of FIG. 6, in modification 2, the step 4 is formed between the outer surface 14R and the auxiliary surfaces 38 and 39, whereas the auxiliary surfaces 38 and 39 are formed at positions different from the third side surface 15 of the partition wall 3A. That is, the step 4 continues from the back surface portion 140 side to the auxiliary surface 38 and 39 side, whereas a partition wall 3B is arranged at a position closer to the front surface portion 240 side as compared with the auxiliary surfaces 38 and 39.

As a result, in modification 2, the volume of the ink storage chamber 2 is smaller than that of the first exemplary embodiment, whereas the volume of the absorber storage chamber 1 is increased. As in the case of the first exemplary embodiment, modification 2 is formed such that the area of the bottom surface 12 of the absorber storage chamber 1 is smaller than the area of the top surface 11 thereof. Thus, as compared with the ink tank whose top surface and bottom surface are of the same area, the amount of ink remaining at the bottom surface of the ink tank is suppressed, whereby an improvement is achieved in terms of ink utilization ratio.

1-6. Other Modifications (I) While in the first exemplary embodiment described above the step 4 is formed on both the third side surface 15 and the fourth side surface, it is also possible for the step to be provided on one of the third side surface 15 and the fourth side surface 16. Further, even in the case where, as in the first exemplary embodiment, the step 4 is provided on both sides, it is possible to adjust as appropriate the respective heights, widths, etc., of the step portions 45 and 46.

Regarding the number of steps 4 formed on the side surfaces, it may be one as in the present exemplary embodiment, or two or more. That is, the number of steps may be changed as appropriate so long as the width of the bottom surface 12 can be made smaller than that of the top surface 11.

(II) While in the first exemplary embodiment described above the sectional configuration when the absorber storage chamber 1 is cut by a plane parallel to the partition wall 3 and passing through the ink supply port 71, is substantially T-shaped, this should not be construed restrictively. For example, the sectional configuration of the absorber storage chamber 1 may also be substantially reverse L-shaped.

Further, while in the first exemplary embodiment described above the sectional configuration when the absorber 5 stored in the absorber storage chamber 1 is cut by a plane parallel to the partition wall 3 and passing through the ink supply port 71, is substantially T-shaped, this should not be construed restrictively. For example, the sectional configuration of the absorber 5 may also be substantially reverse L-shaped.

In the case of the T-shaped sectional configuration, the ink supply port 71 formed in the bottom surface 12 can be arranged at the central portion of the ink tank 100, so that it is advantageously easier to uniformly control the ink flow.

(III) While in the first exemplary embodiment the absorber upper portion 51 and the absorber lower portion 52 constituting the absorber 5 are separate members, it is also possible for the absorber upper portion 51 and the absorber lower portion 52 to be integrated with each other.

(IV) While in the first exemplary embodiment the atmosphere introducing groove 32 functioning as the atmosphere communicating path for promoting the introduction of atmospheric air into the ink storage chamber 2 at the time of ink supply operation, is arrange in the partition wall 3, it is also possible not to provide the atmosphere introducing groove 32 in the partition wall 3. In this case, the step portions 45 and 46 (i.e., the interface C1 between the first absorber 53 and the second absorber 54) above the upper end portion of the communicating port 31.

(V) In the first exemplary embodiment, instead of being formed as a through-hole in the partition wall 3, the communicating port 31 may be made, for example, of a gap formed by spacing the bottom surface portion 120 and the partition wall 3 away from each other so as to provide a "gap" between the bottom surface 12 and the lower end of the partition wall 3.

(VI) While in the first exemplary embodiment described above the steps 4 (the step portions 45 and 46) are arranged on both sides in the width direction Y of the ink tank 100, it is also possible to arrange the steps 4 on both sides in the longitudinal direction X, or on both sides in both the width direction Y and the longitudinal direction X.

Figure 9:
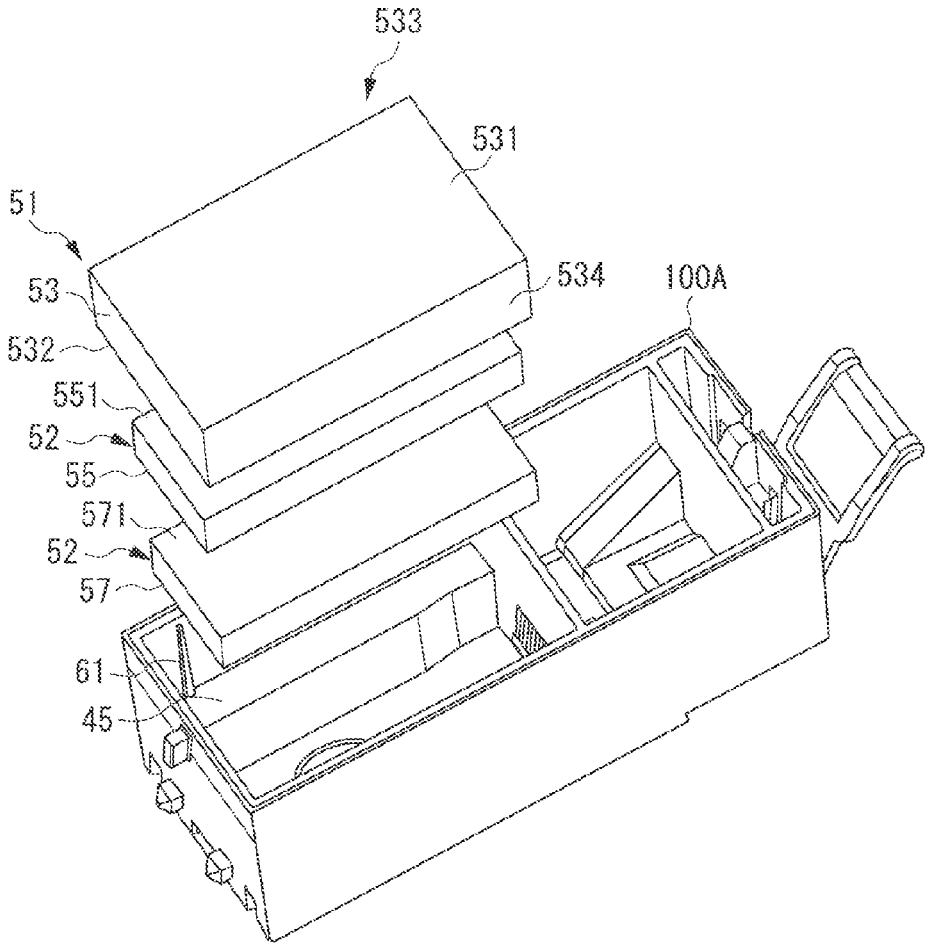
FIG. 9 is a conceptual perspective view illustrating the state prior to the assembly of the ink tank according to the second exemplary embodiment.

(VII) While in the first exemplary embodiment described above the absorber 5 is of a double-layer structure, it is also possible to adopt a three-layer structure or a structure with four layers and more as illustrated in FIG. 9. That is, a multilayer structure is widely applicable.

(VIII) As illustrated in FIG. 1C, 2A, or 4A through 4C, in the first exemplary embodiment, the ink storage chamber 2 has inclined portions 79 inclined downwards from the sixth side surface 24 side toward the fifth side surface 23 side. The inclined portions 79 are provided at the corner portion formed by the sixth side surface 24 and the seventh side surface 17 and at the corner portion formed by the sixth side surface 24 and the eighth side surface 18.

The provision of the inclined portions 79 is not indispensable. However, by providing the inclined portions 79, when using the ink in the ink storage chamber 2, the ink is easily gathered to the absorber storage chamber 1 side, so that the reduction in the ink residual amount in the ink tank 100 is further promoted. Apart from the inclined portions 79, it is also possible to change the right angle of the corner portions to an obtuse angle, or to eliminate the corner portions. This helps to shorten the distance from the corner portions to the communicating port 31, so that the amount of ink remaining at the corner portions is reduced. Further, apart from the function of reducing the ink residual amount, the inclined portions 79 of the present exemplary embodiment can also function as positioning portions or guide portions when attaching the ink tank 100 to an inkjet holder (not illustrated) on the printer side.

2. Second Exemplary Embodiment

In the following, a second exemplary embodiment of the present disclosure will be described with reference to FIGS. 7A and 7B through 11.

A description of the portions common to the first exemplary embodiment will be left out. The following description will center on the differences.

Figure 7A:
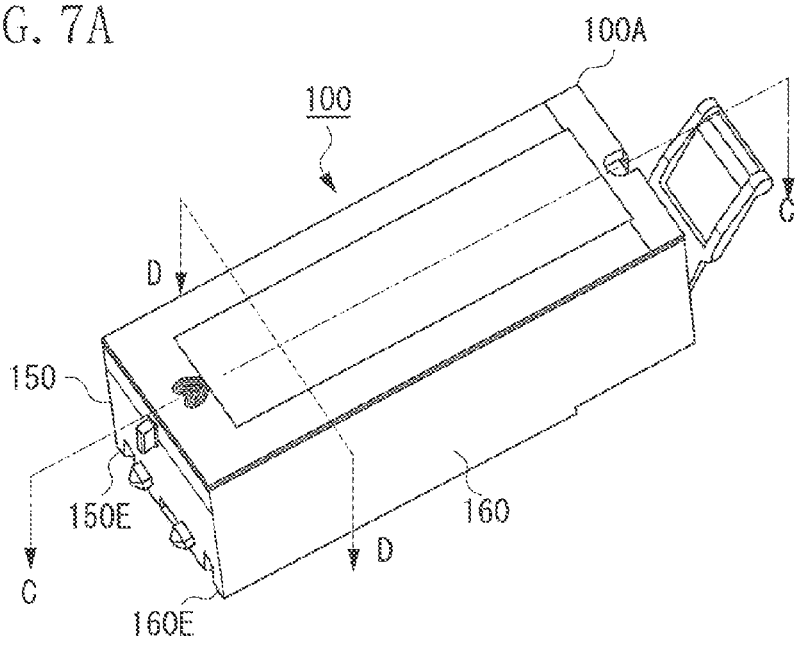
FIG. 7A is a conceptual diagram, as seen from above, illustrating an ink tank according to a second exemplary embodiment.
Figure 7B:
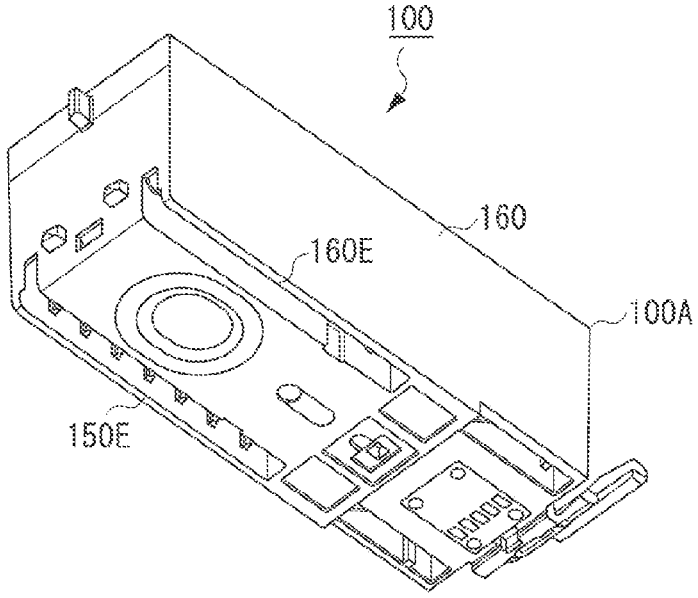
FIG. 7B is a conceptual diagram, as seen from below, illustrating the ink tank.

FIG. 7A is a perspective view, as seen obliquely from above (the cover portion side), of the ink tank in the attitude of use, and FIG. 7B is a perspective view, as seen obliquely from below (the bottom surface side), of the ink tank in the attitude of use.

Figure 8A:
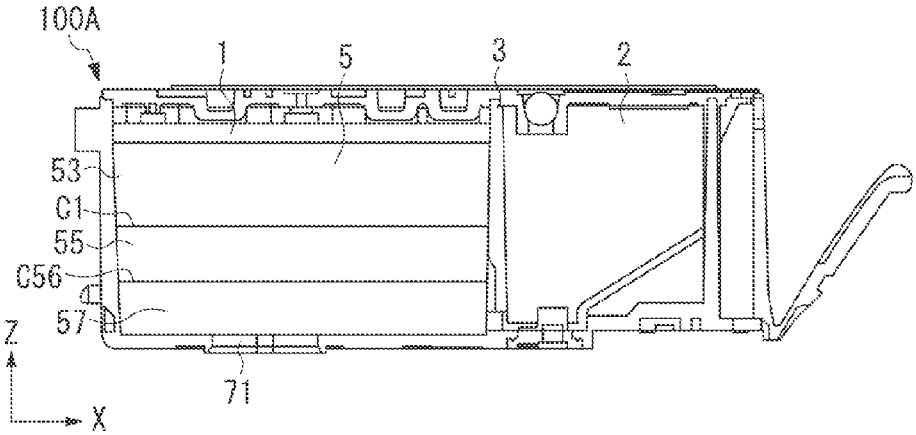
FIG. 8A is a conceptual sectional view, taken along the line C-C in FIG. 7A, of the ink tank.
Figure 8B:
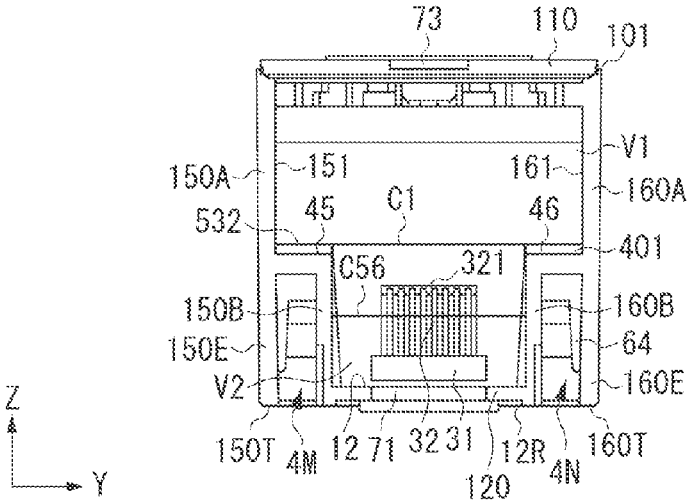
FIG. 8B is a conceptual sectional view, taken along the line D-D in FIG. 7A, of the ink tank.

FIG. 8A is a sectional view taken along the line C-C in FIG. 7A (a sectional view taken along a plane perpendicularly crossing the lateral direction Y). FIG. 8B is a sectional view taken along the line D-D in FIG. 7A (a sectional view taken along a plane perpendicularly crossing the longitudinal direction X).

FIG. 9 is a perspective view illustrating the state prior to the assembly of the ink tank according to the second exemplary embodiment (the state prior to the insertion of the absorber 5).

Figure 10A:
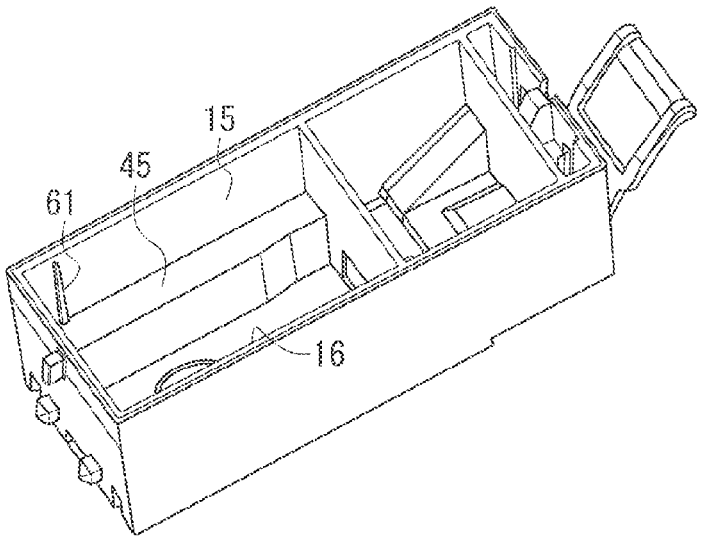
FIG. 10A is a conceptual perspective view illustrating the state in which no absorber has been inserted into the ink tank according to the second exemplary embodiment yet.
Figure 10B:
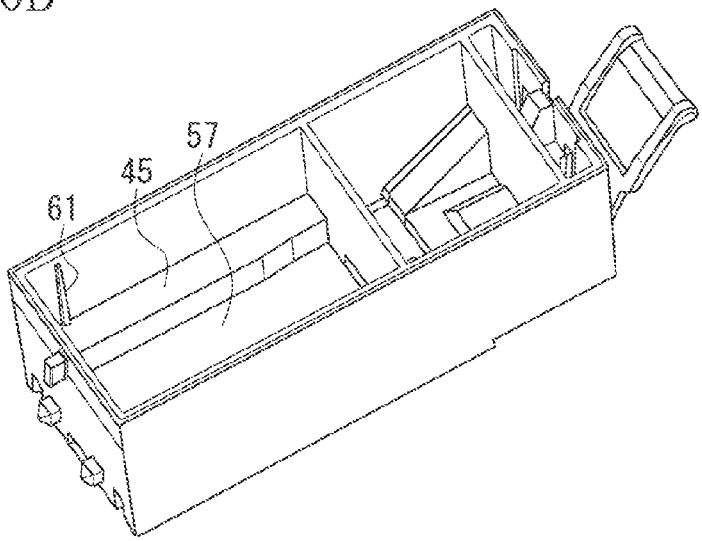
FIG. 10B is a conceptual perspective view illustrating the state in which solely a lower-layer absorber has been inserted into the ink tank.
Figure 10C:
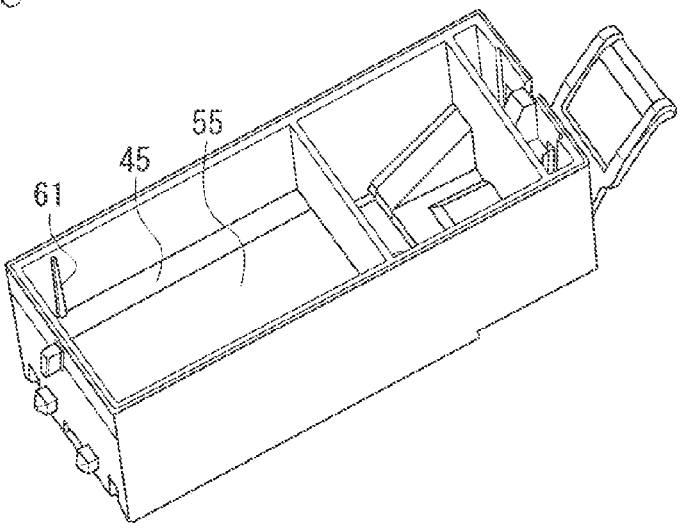
FIG. 10C is a conceptual perspective view illustrating the state in which a medium-layer absorber has been inserted into the ink tank.
Figure 10D:
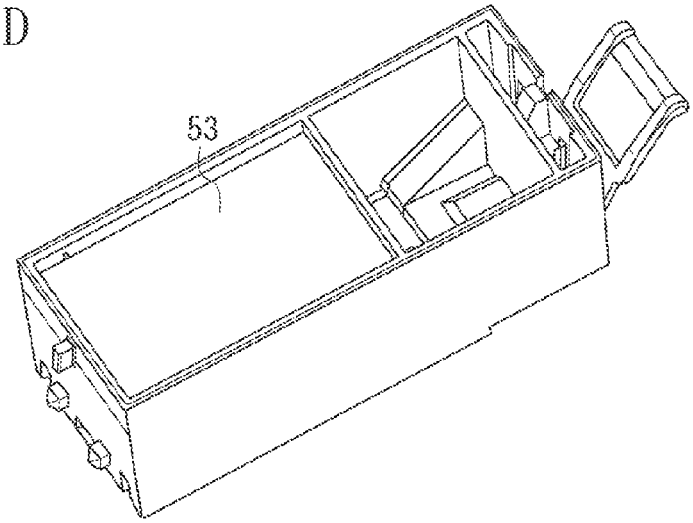
FIG. 10D is a conceptual perspective view illustrating the state in which an upper-layer absorber has been inserted into the ink tank.

FIG. 10A illustrates the state in which the absorber 5 has not been inserted into the ink tank 100 yet. FIG. 10B illustrates the state in which a second absorber B (lower layer) 57 has been inserted into the ink tank 100. FIG. 10C illustrates the state in which a second absorber A55 (medium layer) has been inserted into the ink tank 100. FIG. 10D illustrates the state in which the first absorber (upper layer) 53 has been inserted into the ink tank 100.

Figure 11:
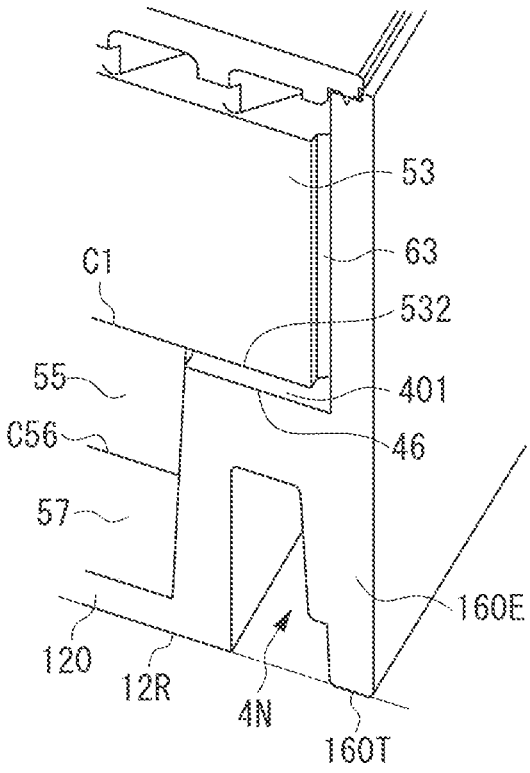
FIG. 11 is an enlarged partial sectional view taken along the line D-D in FIG. 7A.
Figure 12:
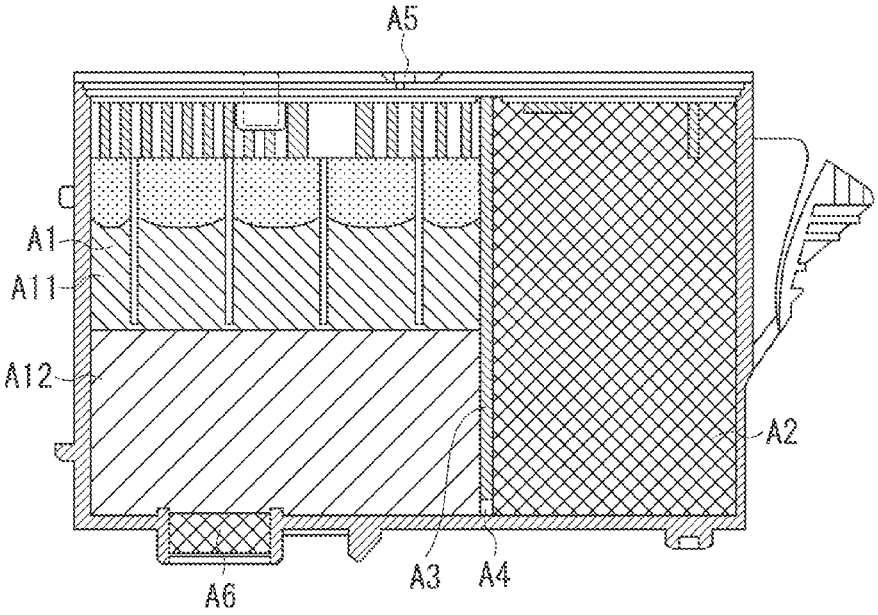
FIG. 12 is a conceptual sectional view of a conventional ink tank.

FIG. 11 is a partially enlarged sectional view taken along the line D-D in FIG. 7A.

2-1. Side Wall Extension Portion

As illustrated in FIG. 7A, 7B, or 8B, in the casing 100A of the ink tank 100 according to the present exemplary embodiment, the side-surface first-portion 150 and the side-surface second-portion 160 are respectively equipped with side wall extension portions 150E and 160E.

More specifically, the side-surface first-portion 150 is equipped with the side wall extension portion 150E extending along the planar direction of the third side surface upper portion 151. Further, the side-surface second-portion 160 is equipped with the side wall extension portion 160E extending along the planar direction of the fourth side surface upper portion 161.

Like the side-surface first-portion upper portion 150A and the side-surface second-portion upper portion 160A, the side wall extension portions 150E and 160E are substantially parallel to the side-surface first-portion lower-portion 150B and the side-surface second-portion lower-portion 160B, and are formed so as to extend in the longitudinal direction X.

Further, as illustrated in FIGS. 7A, 7B, 8B, and 11, end surfaces 150T and 160T of the side wall extension portions 150E and 160E are formed so as to be substantially flush with the bottom surface portion 120 (the back surface 12R of the bottom surface 12) in which the ink supply port 71 is formed. As a result, when bonding the cover (to surface portion) 110 to the casing 100A main body by ultrasonic fusion bonding, it is possible to efficiently impart vibration energy to the fusion-bonded portion between the casing 100A main body and the cover (top surface portion) 110.

More specifically, when performing fusion bonding by ultrasonic fusion bonding, a vibration horn is pressed against both objects to be fusion-bonded to emanate ultrasonic vibration to impart energy thereto, whereby both objects are melted by heat. Thus, it is important to efficiently transmit the energy emanated from the vibration horn to the objects.

At the time of ultrasonic fusion bonding, a pressing force is applied by a jig receiving the casing 100A via the substantially flat bottom surface portion 120 including the end surfaces 150T and 160T (flush surfaces), so that the it is possible to efficiently transmit the vibration energy sent from the cover (top surface portion 110) side via the horn by virtue of the fusion-bonded portion between the cover (top surface portion 110) and the opening 101 (the portion of the casing 100A main body other than the cover).

While in the present exemplary embodiment ultrasonic fusion bonding is employed for the fusion bonding between the top surface portion 110 and the portion of the casing 100A main body 100A other than the cover (top surface portion 110), it is also possible to employ some other bonding method such as heat-plate fusion bonding, laser fusion bonding, or adhesion.

Further, in the present exemplary embodiment, the side surfaces of the side wall extension portions 150E and 160E facing the side-surface first-portion lower-portion 150B and the side-surface second-portion lower-portion 160B are equipped with ribs 64 extending in the vertical direction Z. As a result, the strength of the side wall extension portions 150E and 160E is enhanced, and it is possible to reliably transmit vibration energy at the time of ultrasonic welding. The ribs 64 are formed so as to extend to the back surfaces of the step portions 45 and 46 along the surfaces of the side wall extension portions 150E and 160E.

A groove portion 4M is formed in the outer surface 12R of the bottom surface portion 120 (the lower surface of the casing 100A; the back surface of the bottom surface 12) so as to divide the side wall extension portion 150E and the side-surface first-portion lower-portion 150B from each other. Similarly, a groove portion 4N is formed in the outer surface 12R so as to divide the side wall extension portion 160E and the side-surface second-portion lower-portion 160B from each other. The groove portions 4M and 4N are parallel to the side-surface first-portion 150 and the side-surface second-portion 160, and are formed so as to extend in the longitudinal direction X to sandwich the ink supply port 71.

It is possible to form ribs on the printer side carriage (not illustrated) in correspondence with the groove portions 4M and 4N. Due to the corresponding relationship between the printer side ribs and the groove portions 4M and 4N of the ink tank 100, it is possible to attach the ink tank 100 to the printer more easily.

2-2. Absorber

As illustrated in FIGS. 8A, 8B, 9, and 10A through 10D, the absorber 5 according to the present exemplary embodiment is composed of three layers: a second absorber B57 (lower layer) constituting the absorber lower portion 52, a second absorber A55 (medium layer), and a first absorber 53 constituting the absorber upper portion (upper layer), which are inserted in that order into the absorber storage chamber 1 via the opening 101.

That is, in the present exemplary embodiment, the absorber upper portion 51 has a single-layer construction including a single layer (first absorber 53), and the absorber lower portion 52 has a double-layer construction (multilayer construction) including two absorbers (the second absorber A55 and the second absorber B57). The second absorber B57 (lower layer), the second absorber A55 (medium layer), and the first absorber 53 (upper layer) are stacked together in the height direction Z.

After the absorber 5 has been inserted, the top surface portion 110 (illustrated in FIG. 7A) is mounted to the casing 100A, and the absorber 5 is sealed in the ink tank 100.

The absorber 5 according to the present exemplary embodiment is an aggregate of olefin type resin fibers. The first absorber 53 employs fibers of a fiber diameter of approximately 31 μm, and the second absorber A55 (medium layer) and the second absorber B57 (lower layer) employ fibers of a fiber diameter of approximately 18 μm.

When the second absorber A55 (medium layer) and the second absorber B57 (lower layer) are forcibly inserted into the absorber storage chamber 1 (the casing 100A) via the first absorber 53, due to the dimensional tolerance of the casing 100A and the dimensional tolerance of the absorber 5, the second absorber A55 (medium layer) and the second absorber B57 (lower layer) do not completely undergo crushing deformation with respect to the compressive force (pressing force) from the first absorber 53 in the Z-direction, and there is the possibility of the bottom surface 532 of the first absorber 53 being somewhat spaced away (raised) from the step portions 45 and 46 of the absorber storage chamber 1.

More specifically, as a result of the insertion of the first absorber 53, the second absorber A55 (medium layer) and the second absorber B57 (lower layer) are crushed to be deformed, and the bottom surface 532 of the first absorber 53 moves toward the step portions 45 and 46. In this process, the dimensional tolerance of the first absorber 53 such as the fiber amount and fiber diameter is set to minimum and the rigidity thereof is also set to minimum, whereas the tolerance of the second absorber A55 (medium layer) and the second absorber B57 (lower layer) such as the fiber amount and fiber diameter is set to maximum, and the rigidity thereof is also set to maximum. In this case, the rigidity of the first absorber 53 is lower than that of the second absorber A55 (medium layer) and the second absorber B57 (lower layer), and the first absorber 53 may be more subject to crushing deformation as compared with the second absorber A55 (medium layer) and the second absorber B57 (lower layer). Thus, when the first absorber 53 as a whole is inserted into the absorber storage chamber 1, it is to be expected that the bottom surface 532 of the first absorber 53 will be spaced away (raised) from the step portions 45 and 46 as a result of the reaction force the first absorber 53 receives from the second absorber A55 (medium layer) and the second absorber B57 (lower layer). Therefore, as illustrated in FIGS. 8B and 11, a space 401 described below is formed between the first absorber 53 and the step portions 45 and 46.

Setting is made such that, in the state in which the insertion of the three-layer absorber 5 into the absorber storage chamber 1 has been completed, the top surface 551 of the second absorber A55 (medium layer) is situated above the positions of the step portions 45 and 46 in the height direction Z, and the top surface 571 of the second absorber B57 (lower layer) is situated below the positions of the step portions 45 and 46 and the position of the upper end portion 321 of the communicating port 31 (the atmosphere introducing groove 32). Further, in the width direction Y, the first absorber 53 is wider than the second absorber A55 (medium layer) and the second absorber B57 (lower layer).

Further, when the first absorber 53 is inserted into the absorber storage chamber 1, even if the first absorber 53 is forced in to the maximum degree, it abuts on the step portions 45 and 46, so that there is no fear of the second absorber B57 (lower layer) and the second absorber A55 (medium layer) being excessively compressed.

In the following the interface C1 between the first absorber 53 and the second absorber A55 (medium layer), and the interface C56 between the second absorber A55 (medium layer) and the second absorber B57 (lower layer), will be described.

The absorber 5, including the three layers of the second absorber B57 (lower layer), the second absorber A55 (medium layer), and the first absorber 53 (upper layer), is stored in the absorber storage chamber 1, so that there are formed two interfaces C1 and C56.

As illustrated in FIGS. 8A and 8B, the interface C56 between the second absorber B57 (lower layer) and the second absorber A55 (medium layer) is arranged so as to be orthogonal to the atmosphere introducing groove 32. Further, the lower atmosphere introducing groove 32 is formed in the partition wall 3 so as to be astride the second absorber A55 (medium layer) and the second absorber B57 (lower layer). On the other hand, when the ink tank is in the attitude of use, the interface C1 between the first absorber 53 and the second absorber A55 (medium layer), is arranged so as to be situated above the upper end portion 321 of the atmosphere introducing groove 32.

Further, since the interface C1 is arranged so as to be situated above the upper end 321 of the atmosphere introducing groove 32, the interface C1 functions, as in the first exemplary embodiment, as a barrier to the movement of air and liquid, and the air allowed to enter the absorber storage chamber 1 from the atmosphere communicating port 73 (atmosphere communicating groove 72) is cut off, thus providing an ink leakage preventing effect.

The ink retaining forces (capillary forces) of the three layers constituting the absorber 5 are set as follows: first absorber 53<second absorber A55 (medium layer)<second absorber B57 (lower layer). Thus, as compared with the ink occluded by the second absorber A55 (medium layer), the ink occluded by the second absorber B57 (lower layer) offers larger resistance when drawn out to the print head (not illustrated) side. In other words, the ink within the second absorber B57 (lower layer) is more firmly retained than the ink within the second absorber A55 (medium layer), so that it is not easily allowed to flow out. That is, in the state in which ink is secured in the second absorber B (occlusion-saturated state), it is possible to draw out the ink within the second absorber A on a priority basis, making it possible to expose the atmosphere introducing groove 32 to the atmosphere while the ink within the second absorber A is being used. As a result, in the state in which the ink within the second absorber B57 (lower layer) is secured, it is possible for the atmospheric air to effect gas-liquid exchange on the ink in the absorber storage chamber 1 and the ink storage chamber 2 via the atmosphere introducing groove 32, making it possible to supply ink to the printer head in a stable manner.

While in the present exemplary embodiment described above there is employed the three-layer absorber 5 (the first absorber 53, the second absorber A55, and the second absorber B57), the present disclosure is also applicable to a double-layer structure as in the first exemplary embodiment or to a structure having four or more layers.

2-3. Ribs

When ink is injected into the ink tank 100 in the state in which the space 401 (illustrated in FIG. 11) exists between the first absorber 53 (i.e., the bottom surface 532 thereof) and the step portion 46 (45), there is the possibility of ink being allowed to enter the space 401. The ink existing in the space 401 is not retained by the absorber 5, so that, when the ink tank 100 is unsealed or when a shock or the like is applied thereto, there is the possibility of overflow from the atmosphere communicating port 73 (atmosphere communicating groove 72), the ink supply port 71, etc.

To solve this problem, as illustrated in FIGS. 9, 10A, 10B, and 10C, in the present exemplary embodiment, there are provided vertically extending ribs 61 on the third side surface 15 and the fourth side surface 16 and above the step portions 45 and 46. In the state in which the first absorber 53 has been inserted, both side surfaces 533 and 534 perpendicular to the Y-direction of the first absorber 53 (illustrated in FIG. 9) are regulated in configuration due to the ribs 61 provided on the third side surface 15 and the fourth side surface 16, and the periphery of the ribs 61 is recessed to form a recess portion (air path) 63 (illustrated in FIG. 11). This recess portion 63 extends along side surfaces 533 and 534 of the first absorber 53 in the vertical direction Z from the top surface 531 to the bottom surface 532 (step portions 45 and 46) of the first absorber 53, whereby there is formed the air path 63 allowing passage of air. The space 401 communicates with the atmosphere communicating port 73 (atmosphere communicating groove 72) via the air path (recess portion) 63, whereby it is possible for the space to be constantly open to the atmosphere. As a result, even when the ink tank 100 is unsealed or when a shock is applied thereto, it is possible to mitigate the problem of ink overflow from the atmosphere communicating port 73 (atmosphere communicating groove 72), the ink supply port 71, etc.

More specifically, even when ink oozes out into the space 401 as a result of expansion of minute bubbles existing in the absorber 5, dissolved bubbles in the ink, etc., due to environmental changes during transportation, the space 401 communicates with the atmosphere via the air path 63 at the time of unsealing, so that it is possible for the ink oozing out into the space 401 to be quickly absorbed by the absorber 5 to be retained therein.

Further, even when some ink is allowed to gather in the space 401 after the injection of the ink, it is possible to remove the ink in the space 401 before the shipment by adding the step of extracting the ink by utilizing the air path 63 formed by the ribs 61.

Further, due to the provision of the air path 63 by virtue of the ribs 61, even if the air taken into the first absorber 53 expands when the user unseals the ink tank in a reduced-pressure environment, the air can quickly flow out to the atmosphere communicating port 73 (the atmosphere communicating groove 72), so that it is possible to suppress ink overflow (ink leakage) due to the expanded air.

While in the present exemplary embodiment the ribs 61 are arranged on the third side surface 15 and the fourth side surface 16, it goes without saying that the layout of the ribs 61 is not restricted to the above-described one so long as it is possible for the air path 63 (connecting the surface 531 and the bottom surface 532) so as to extend astride the first absorber 53. It is also possible for the ribs to be provided on the inner surface on the back surface portion 140 side (the second side surface 14) and the side surface of the partition wall 3 facing the absorber storage chamber 1 (the first side surface 13). Further, instead of being formed by the above-described ribs 61, the air path 63 may be formed by a groove portion allowing passage of air. It is necessary for the lower ends 62 of the ribs 61 (the air path 63) to be situated above the step portions 45 and 46.

With the above construction, it is possible to achieve an improvement in terms of reliability with respect to ink dripping (leakage). At the same time, it is possible to achieve an improvement in terms of ink use efficiency.

The above-described exemplary embodiments of the present invention should not be construed restrictively. Insofar as based on the technical idea of the present invention, they allow modification as appropriate without departing from the scope of the appended claims and a scope equivalent thereto.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-287248 filed Dec. 28, 2012, which is hereby incorporated by reference herein in its entirety.

What is claimed is:

1. An ink tank comprising:

a casing having a partition wall configured to divide from each other an absorber storage chamber for storing an absorber capable of retaining ink and an ink storage chamber for storing ink to be supplied to the absorber storage chamber, wherein the absorber storage chamber has a bottom surface having an ink supply port for supplying the ink in the absorber storage chamber to an outside, a top surface opposite the bottom surface, a first side surface serving also as one surface of the partition wall, a second side surface opposite the first side surface, and a third side surface and a fourth side surface connecting the first side surface and the second side surface and being positioned or disposed opposite to each other, wherein a width of the bottom surface is smaller than a width of the top surface in a width direction parallel to the bottom surface and orthogonal to a longitudinal direction which is parallel to the bottom surface and in which the absorber storage chamber, the partition wall, and the ink storage chamber are arranged, wherein a first step is provided on the third side surface and a second step is provided on the fourth side surface so the distance between a portion of the third side surface and a portion of the fourth side surface in the width direction is smaller on the bottom surface side than on the top surface side, the first and second steps extending from the second side surface along a length of the casing for a predetermined distance that is less than the length of the casing, and wherein a plurality of the absorbers are stored in the absorber storage chamber.

2. The ink tank according to claim 1, wherein each of the third side surface and the fourth side surface has:

an upper portion connected to the top surface;

a lower portion connected to the bottom surface; and a step portion connecting the upper portion and the lower portion such that the respective step is formed between the upper portion and the lower portion.

3. The ink tank according to claim 2, wherein when the absorber storage chamber is cut by a plane containing the step portion of the third side surface and the step portion of the fourth side surface, a volume of an upper space formed by the top surface, the upper portion of the first side surface, the upper portion of the second side surface, the upper portion of the third side surface, and the upper portion of the fourth side surface, is larger than a volume of a lower space formed by the bottom surface, the lower portion of the first side surface, the lower portion of the second side surface, the lower portion of the third side surface, and the lower portion of the fourth side surface.

4. The ink tank according to claim 2, wherein at least one of the step portion of the third side surface and the step portion of the fourth side surface is opposite the top surface and extends from the first side surface to the second side surface.

5. The ink tank according to claim 2, wherein the absorber has an absorber upper portion above at least one of the step portion of the third side surface and the step portion of the fourth side surface and an absorber lower portion below at least one of the step portion of the third side surface and the step portion of the fourth side surface, and wherein, in the width direction, a width of the absorber lower portion is smaller than a width of the absorber upper portion.

6. The ink tank according to claim 5, wherein the casing has a communicating port establishing communication between the absorber storage chamber and the ink storage chamber, wherein the partition wall has an atmosphere introducing groove extending from the communicating port toward the top surface side, wherein the absorber upper portion and the absorber lower portion are made of separate members, wherein the interface between the absorber upper portion and the absorber lower portion is positioned above at least one of the step portion of the third side surface and the step portion of the fourth side surface, and wherein at least one of the step portion of the third side surface and the step portion of the fourth side surface is positioned above an upper end of the atmosphere introducing groove.

7. The ink tank according to claim 6, wherein the absorber lower portion is formed by a plurality of layers including a plurality of absorbers.

8. The ink tank according to claim 5, wherein when the absorber upper portion and at least one of the step portion of the third side surface and the step portion of the fourth side surface are projected onto the same plane along a direction orthogonal to the bottom surface, a part of the absorber upper portion overlaps at least one of the step portion of the third side surface and the step portion of the fourth side surface.

9. The ink tank according to claim 2, wherein the absorber storage chamber is equipped with a rib or a groove extending from the bottom surface side toward the top surface side on at least one of the first side surface, the second side surface, the third side surface, and the fourth side surface, and wherein a lower end of the rib or the groove is arranged above at least one of the step portion of the third side surface and the step portion of the fourth side surface.

10. The ink tank according to claim 2, wherein the sectional configuration, when the absorber storage chamber is cut by a plane parallel to the partition wall and passing through the ink supply port, is substantially T-shaped.

11. The ink tank according to claim 10, wherein the sectional configuration, when the absorber stored in the absorber storage chamber is cut by a plane parallel to the partition wall and passing through the ink supply port, is substantially T-shaped.

12. The ink tank according to claim 1, wherein at least one of the third side surface and the fourth side surface has:

an upper portion connected to the top surface;

a lower portion connected to the bottom surface; and a step portion connecting the upper portion and the lower portion so the respective step is formed between the upper portion and the lower portion.

13. The ink tank according to claim 12, wherein the sectional configuration, when the absorber storage chamber is cut by a plane parallel to the partition wall and passing through the ink supply port, is substantially reverse-L-shaped.

14. The ink tank according to claim 13, wherein the sectional configuration, when the absorber stored in the absorber storage chamber is cut by a plane parallel to the partition wall and passing through the ink supply port, is substantially reverse L-shaped.

15. The ink tank according to claim 1, wherein a width in the width direction of the ink storage chamber is larger than a width in the width direction of the bottom surface side of the absorber storage chamber.

16. The ink tank according to claim 1, wherein the width in the width direction of the ink storage chamber is substantially equal to the width in the width direction of the top surface side of the absorber storage chamber.

17. The ink tank according to claim 1, wherein a sectional configuration when the ink storage chamber is cut by a plane parallel to the partition wall is substantially rectangular.

18. The ink tank according to claim 1, wherein the step of the third side surface and the step of the fourth side surface extend from the second side surface toward the partition wall to respective predetermined positions in the absorber storage chamber, the predetermined position of the step of the third side surface and the predetermined position of the step of the fourth side surface both being spaced away from the partition wall.

19. The ink tank according to claim 1, wherein the step of the third side surface and the step of the fourth side surface extend from the second side surface toward and through the partition wall to respective predetermined positions in the ink storage chamber, the predetermined position of the step of the third side surface and the predetermined position of the step of the fourth side surface both being spaced away from the partition wall.

20. An ink tank comprising:

a casing having a partition wall configured to divide from each other an absorber storage chamber for storing an absorber capable of retaining ink and an ink storage chamber for storing ink to be supplied to the absorber storage chamber, wherein the absorber storage chamber has a bottom surface having an ink supply port for supplying the ink in the absorber storage chamber to an outside, a top surface opposite the bottom surface, a first side surface serving also as one surface of the partition wall, a second side surface opposite the first side surface, and a third side surface and a fourth side surface connecting the first side surface and the second side surface and being positioned or disposed opposite to each other, wherein each of the third side surface and the fourth side surface has: an upper portion connected to the top surface, a lower portion connected to the bottom surface, and a step portion connecting the upper portion and the lower portion and extending from the first side surface to the second side surface, wherein the distance in a width direction between a portion of the third side surface and a portion of the fourth side surface is smaller on the bottom surface side than on the top surface side, wherein, in a width direction parallel to the bottom surface and orthogonal to the longitudinal direction which is parallel to the bottom surface and in which the absorber storage chamber, the partition wall, and the ink storage chamber are arranged, a width of the bottom surface is smaller than a width of the top surface, wherein the absorber has an absorber upper portion above at least one of the step portion of the third side surface and the step portion of the fourth side surface and an absorber lower portion below at least one of the step portion of the third side surface and the step portion of the fourth side surface, wherein the ink tank has a plurality of the absorbers, wherein, in the width direction, a width of the absorber lower portion is smaller than a width of the absorber upper portion, and wherein the step portion of the third side surface and the step portion of the fourth side surface each extend from the second side surface along a length of the casing for a predetermined distance that is less than the length of the casing.

21. The ink tank according to claim 20, wherein the casing has a communicating port establishing communication between the absorber storage chamber and the ink storage chamber, wherein the partition wall has an atmosphere introducing groove extending from the communicating port toward the top surface side, wherein the absorber upper portion and the absorber lower portion are made of separate members, wherein the interface between the absorber upper portion and the absorber lower portion is positioned above at least one of the step portion of the third side surface and the step portion of the fourth side surface, and wherein at least one of the step portion of the third side surface and the step portion of the fourth side surface is situated above an upper end of the atmosphere introducing groove.

22. The ink tank according to claim 21, wherein the absorber lower portion is formed by a plurality of layers including a plurality of absorbers.

23. The ink tank according to claim 22, wherein when the absorber upper portion and at least one of the step portion of the third side surface and the step portion of the fourth side surface are projected onto the same plane along a direction orthogonal to the bottom surface, a part of the absorber upper portion overlaps at least one of the step portion of the third side surface and the step portion of the fourth side surface.

24. The ink tank according to claim 23, wherein the absorber storage chamber is equipped with a rib or a groove, extending from the bottom surface side toward the top surface side on at least one of the first side surface, the second side surface, the third side surface, and the fourth side surface, and wherein a lower end of the rib or the groove is arranged above at least one of the step portion of the third side surface and the step portion of the fourth side surface.

25. The ink tank according to claim 24, wherein the sectional configuration, when the absorber storage chamber is cut by a plane parallel to the partition wall and passing through the ink supply port, is substantially T-shaped.

26. The ink tank according to claim 25, wherein the sectional configuration, when the absorber stored in the absorber storage chamber is cut by a plane parallel to the partition wall and passing through the ink supply port, is substantially T-shaped.

27. The ink tank according to claim 26, wherein a width in a width direction of the ink storage chamber is larger than a width in the width direction of the bottom surface side of the absorber storage chamber.

28. The ink tank according to claim 27, wherein the width in the width direction of the ink storage chamber is substantially equal to the width in the width direction of the top surface side of the absorber storage chamber.

29. The ink tank according to claim 28, wherein the sectional configuration, when the ink storage chamber is cut by a plane parallel to the partition wall, is substantially rectangular.

30. An ink tank comprising:

a casing having a partition wall configured to divide from each other an absorber storage chamber for storing an absorber capable of retaining ink and an ink storage chamber for storing ink to be supplied to the absorber storage chamber, wherein the absorber storage chamber has a bottom surface having an ink supply port for supplying the ink in the absorber storage chamber to an outside, a top surface opposite the bottom surface, a first side surface serving also as one surface of the partition wall, a second side surface opposite the first side surface, and a third side surface and a fourth side surface connecting the first side surface and the second side surface and being positioned or disposed opposite to each other, wherein each of the third side surface and the fourth side surface has: an upper portion connected to the top surface, a lower portion connected to the bottom surface, and a step portion connecting the upper portion and the lower portion, wherein the distance in the width direction between a portion of the third side surface and a portion of the fourth side surface is smaller on the bottom surface side than on the top surface side, wherein the absorber has an absorber upper portion above at least one of the step portion of the third side surface and the step portion of the fourth side surface and an absorber lower portion below at least one of the step portion of the third side surface and the step portion of the fourth side surface, wherein the ink tank has a plurality of the absorbers, wherein, in a width direction parallel to the bottom surface and orthogonal to a longitudinal direction which is parallel to the bottom surface and in which the absorber storage chamber, the partition wall, and the ink storage chamber are arranged, the width of the bottom surface is smaller than a width of the top surface, and a width of the absorber lower portion is smaller than a width of the absorber upper portion, wherein when the absorber storage chamber is cut by a plane containing the step portion of the third side surface and the step portion of the fourth side surface, a volume of a lower space formed by the bottom surface, the lower portion of the first side surface, the lower portion of the second side surface, the lower portion of the third side surface, and the lower portion of the fourth side surface, is smaller than a volume of an upper space formed by the top surface, the upper portion of the first side surface, the upper portion of the second side surface, the upper portion of the third side surface, and the upper portion of the fourth side surface, and wherein the step portion of the third side surface and the step portion of the fourth side surface each extend from the second side surface along a length of the casing for a predetermined distance that is less than the length of the casing.

31. The ink tank according to claim 30, wherein when the absorber upper portion and at least one of the step portion of the third side surface and the step portion of the fourth side surface are projected onto the same plane along a direction orthogonal to the bottom surface, a part of the absorber upper portion overlaps at least one of the step portion of the third side surface and the step portion of the fourth side surface.

32. The ink tank according to claim 31, wherein the absorber lower portion is formed by a plurality of layers including a plurality of absorbers.

33. The ink tank according to claim 32, wherein a width in the width direction of the ink storage chamber is larger than the width in the width direction of the bottom surface side of the absorber storage chamber.

34. The ink tank according to claim 33, wherein the width in the width direction of the ink storage chamber is substantially equal to the width in the width direction of the top surface side of the absorber storage chamber.

35. The ink tank according to claim 34, wherein the casing has a communicating port establishing communication between the absorber storage chamber and the ink storage chamber, wherein the partition wall has an atmosphere introducing groove extending from the communicating port toward the top surface side, wherein the absorber upper portion and the absorber lower portion are made of separate members, wherein the interface between the absorber upper portion and the absorber lower portion is situated above at least one of the step portion of the third side surface and the step portion of the fourth side surface, and wherein at least one of the step portion of the third side surface and the step portion of the fourth side surface is situated above an upper end of the atmosphere introducing groove.

36. The ink tank according to claim 35, wherein the absorber storage chamber is equipped with a rib or a groove extending from the bottom surface side toward the top surface side on at least one of the first side surface, the second side surface, the third side surface, and the fourth side surface, and wherein a lower end of the rib or the groove is arranged above at least one of the step portion of the third side surface and the step portion of the fourth side surface.

37. The ink tank according to claim 36, wherein at least one of the step portion of the third side surface and the step portion of the fourth side surface is opposite the top surface and extends from the first side surface to the second side surface.

38. The ink tank according to claim 37, wherein the sectional configuration, when the absorber storage chamber is cut by a plane parallel to the partition wall and passing through the ink supply port, is substantially T-shaped.

39. The ink tank according to claim 38, wherein the sectional configuration, when the absorber stored in the absorber storage chamber is cut by a plane parallel to the partition wall and passing through the ink supply port, is substantially T-shaped.

40. The ink tank according to claim 39, wherein the sectional configuration, when the ink storage chamber is cut by a plane parallel to the partition wall, is substantially rectangular.

41. The ink tank according to claim 30, wherein the step portion of the third side surface and the step portion of the fourth side surface extend from the second side surface toward the partition wall to respective predetermined positions in the absorber storage chamber, the predetermined position of the step portion of the third side surface and the predetermined position of the step portion of the fourth side surface both being spaced away from the partition wall.

42. The ink tank according to claim 30, wherein the step portion of the third side surface and the step portion of the fourth side surface extend from the second side surface toward and through the partition wall to respective predetermined positions in the ink storage chamber, the predetermined position of the step of the third side surface and the predetermined position of the step of the fourth side surface both being spaced away from the partition wall.

* * * * *